US006136488A

United States Patent [19]

Kushino et al.

[11] Patent Number: 6,136,488

[45] Date of Patent: Oct. 24, 2000

[54] FLASH FIXING TONER

[75] Inventors: Mitsuo Kushino, Inagawa-cho; Osamu Kaieda, Tsuchiura; Tatsuhito Matsuda, Higashinada-ku; Makoto Matsumoto, Suita, all of Japan

[73] Assignee: Nippon Shokubai Co., Ltd., Osaka-fu, Japan

[21] Appl. No.: 09/116,365

[22] Filed: Jul. 16, 1998

[30] Foreign Application Priority Data

| | | | |
|---|---|---|---|
| Jul. 18, 1997 | [JP] | Japan | 9-194520 |
| Jul. 18, 1997 | [JP] | Japan | 9-194521 |
| Oct. 22, 1997 | [JP] | Japan | 9-289928 |
| Oct. 22, 1997 | [JP] | Japan | 9-289929 |
| Oct. 22, 1997 | [JP] | Japan | 9-289930 |

[51] Int. Cl.[7] ..... G03G 9/09; G03G 9/097

[52] U.S. Cl. ..... 430/106; 430/110

[58] Field of Search ..... 430/106, 110

[56] References Cited

U.S. PATENT DOCUMENTS

| | | | |
|---|---|---|---|
| 4,539,284 | 9/1985 | Barbetta et al. | 430/110 |
| 4,699,863 | 10/1987 | Sawatari et al. | 430/109 |
| 5,189,153 | 2/1993 | Gregory et al. | 540/122 |
| 5,432,035 | 7/1995 | Katagiri et al. | 430/106 |

FOREIGN PATENT DOCUMENTS

| | | |
|---|---|---|
| 0 408 191 A1 | 1/1991 | European Pat. Off. . |
| 0 523 959 A2 | 7/1992 | European Pat. Off. . |
| 60-57857 | 4/1985 | Japan . |
| 60-63546 | 4/1985 | Japan . |
| 61-132959 | 6/1986 | Japan . |
| 63-161460 | 7/1988 | Japan . |
| 3-48685 | 3/1991 | Japan . |

*Primary Examiner*—Roland Martin

*Attorney, Agent, or Firm*—Fish & Richardson P.C.

[57] ABSTRACT

A flash fixing toner comprising a binding resin, a coloring agent, and an infrared absorbent, the infrared absorbent having the largest absorption wavelength in the range of 750–1100 nm, and the infrared absorbent being solved in or being finely dispersed in the binding resin.

16 Claims, No Drawings

FLASH FIXING TONER

BACKGROUND OF THE INVENTION

1. Field of the Invention

This invention relates to a flash fixing toner. More particularly, this invention relates to a flash fixing toner which excels in the flash fixing property and enjoys an economic feature of inexpensiveness.

2. Related Art

As a means to fix an image on a printing sheet or web in the electrophotographic process, the heat roll method has been mainly used conventionally. Since this method consists in causing a printing sheet such as of paper having an image formed with a toner thereon to be passed between hot rolls thereby thermally impressing the toner on the printing sheet, it incurs such problems as exposing the fixing part of a relevant device to the phenomenon of clogging, suffering the resolution to decline because the image is crushed, and imposing a limit on the kind of printing sheet or web.

The flash fixing method is one version of the noncontacting fixing method and is an excellent fixing method free from such problems of the heat roll method as mentioned above. Since this method barely enables the toner to be fused and fixed by relying on some of the components of the toner to absorb the light, particularly the infrared light, of a xenon flash lamp, however, it incurs defective fixing with a color toner which uses mostly a coloring agent having no or only sparing ability to absorb the infrared light.

As a means to solve the problem of defective fixing, JP-A-63-161,460 proposes a concept of having a flash fixing toner incorporate in a dispersed state therein an infrared absorbent showing peaks of light absorption at wavelengths of 800–1100 nm.

JP-A-60-57,858, JP-A-60-63,546, and JP-A-61-132,959 propose a concept of having a toner composition incorporate therein a specific compound showing peaks of light absorption at 800–1100 nm in an amount in the range of 1 wt. %–10 wt. %.

JP-A-03-48,585 discloses a discovery that a phthalocyanine compound having an aliphatic polyaminoammonium or a substituted guanidium ion at the terminal thereof is usable as an energy absorbent in a flash fixing toner.

The toner disclosed in JP-A-63-161,460 is not only inefficient but also unfavorable economically because the infrared absorbent is retained in a dispersed state in the binding resin and, consequently, the amount of the infrared absorbent to be incorporated in the binder is inevitably increased for the purpose of enabling the binding resin to be thoroughly fused by the heat-generating action of the infrared absorbent of this nature. Further, this increase in the amount of addition incurs the problem of affecting the tint of the toner and affecting the charging property. If the amount of the infrared absorbent to be incorporated in the dispersed state is unduly small, it will become necessary to heighten the energy of flash irradiation because no sufficient heat is generated and the fixing occurs only partly or deficiently. If the energy of flash irradiation is heightened as required, the temperature of the locally generated heat rises possibly to the extent of exposing the infrared absorbent itself and the binding resin as well to thermal decomposition and causing the occurrence of voids in the fixed image.

The toners disclosed in JP-A-60-57,858, JP-A-60-63,546, and JP-A-61-132,959 incur the problem of causing color pollution with the infrared absorbent because the amount of the infrared absorbent to be incorporated is relatively large similarly in the toners mentioned above and further because the compound cited as a concrete example is a substance showing only small absorption in the visible region and yet having a dark tint. Further, on account of the structure of the composition and the functional group thereof, the toners incur the problem of the ability to charge the toner.

The phthalocyanine compound disclosed in JP-A-03-48,585 is deficient in the solubility to be manifested to the binding resin which is used in the flash fixing toner. When this phthalo-cyanine compound is elected to be added as an infrared absorbent to the flush fixing toner, the amount of addition is necessarily increased so much as to incur the aforementioned problem of affecting the tint and the ability to charge and also incur the problem of the degradation of the resistance to the environment by the hydrophilic group at the terminal.

The flash fixing toners which are disclosed in the prior patent publications mentioned above are invariably obtained by the pulverizing method.

The pulverizing method does not easily produce a toner which are formed of particles of small diameters. The toner is amorphous morphologically and is deficient in flowability. As a result, the toner cannot fully manifest the feature of the flash fixing which resides in forming an image with high resolution.

Further, the dispersion of the infrared absorbent does not deserve to be called fully satisfactory because no special consideration is paid to the dispersion of the infrared absorbent. For the purpose of ensuring thorough fusion of the binding resin by the heat generating action originating in the absorption of light by the infrared absorbent, therefore, the amount of the infrared absorbent to be added is inevitably increased to the extent of rendering the production of the toner inefficient and uneconomical.

Besides, the increase in the amount of addition also incurs the problem of suffering the tint of the infrared absorbent to pollute colors and the structure of the relevant compound and the functional group thereof to affect the charging property as well.

SUMMARY OF THE INVENTION

This invention, therefore, has for an object thereof the provision of a novel flash fixing toner. It is also an object of this invention to provide a flash fixing toner which has great ability to absorb infrared, excels in the flash fixing property, and enjoys an economic feature of inexpensiveness.

The objects mentioned above are accomplished firstly by a flash fixing toner which is formed of at least a binding resin, a coloring agent, and an infrared absorbent and is characterized by the infrared absorbent having the largest absorption wavelength in the range of 750–1100 nm, the infrared absorbent being solved in the binding resin, and the infrared absorbent being incorporated in the toner in an amount in the range of 0.01 wt. %–1 wt. %, based on the total amount of the toner composition.

In the flash fixing toner according to the first embodiment, the infrared absorbent, when incorporated in an amount of 0.1 part by weight in 100 parts by weight of the binding resin, is preferred to exhibit turbidity of not more than 10 and the coloring agent is preferred to be a coloring agent which produces a color other than black.

In the first embodiment of this invention constructed as described above, the infrared absorbent to be incorporated in the flash fixing toner is disposed in a solved state in the binding resin forming the matrix of the toner particles. In the flash fixing, the part of the infrared absorbent is intended to effect local generation of heat. The infrared absorbent can be expected to manifest the fixing property satisfactorily even if the amount thereof incorporated is small so long as the infrared absorbent is dispersed in a solved state, namely in a state finely dispersed on the molecular level, in the matrix. The amount of the heat locally generated during the flash irradiation is small because the infrared absorbent is uniformly present in the matrix and the partial defective fixing cannot occur because the heat is uniformly generated. Further, since the amount of the infrared absorbent to be incorporated is allowed to be small, the addition of the infrared absorbent in this manner brings about substantially no effect on the tint and the charging property of the toner and proves advantageous economically.

The objects mentioned above are accomplished secondly by a flash fixing toner which is formed of at least a binding resin, a coloring agent, and an infrared absorbent and is characterized by the infrared absorbent being a phthalocyanine type compound represented by the following general formula (I):

(I)

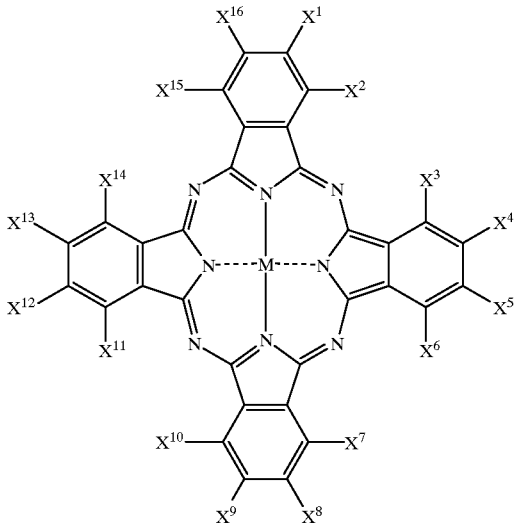

(wherein at least one of the substituents, $X^1$–$X^{16}$, is NH—R (wherein R is an alkyl group of 1–8 carbon atoms or an optionally substituted aryl group) and M is a nonmetal, metal, metal oxide, metal carbonyl, or metal halide).

In the second embodiment of the present invention, the phthalocyanine compound is preferred to have the largest peak of absorption wavelength in the range of 750–1100 nm.

Further, in the second embodiment of this invention, the phthalocyanine compound mentioned above is preferred to be a phthalocyanine compound represented by the following general formula (II) or (III).

(II)

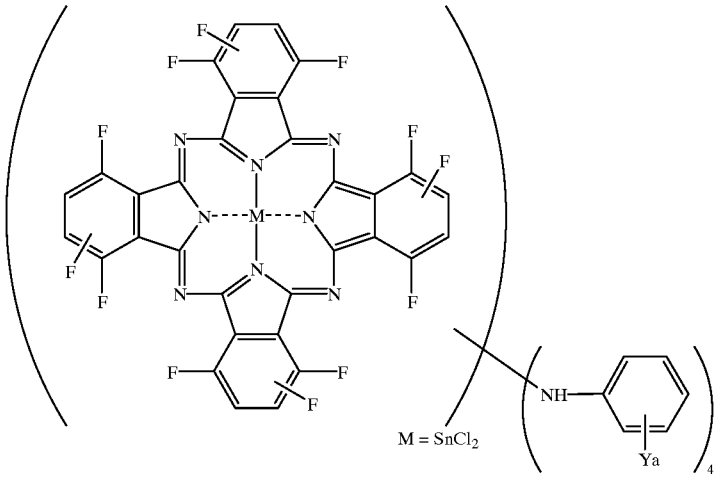

(wherein Y is an alkyl or alkoxyl group of 1–4 carbon atoms and a is 1 or 2)

(III)

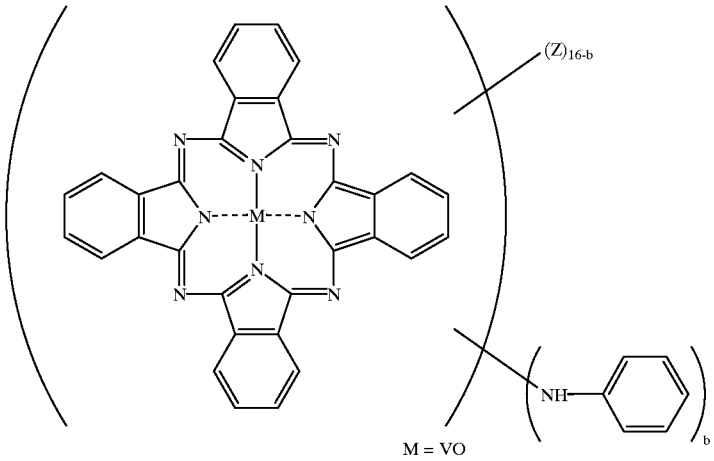

(wherein Z is an optionally substituted phenylthio group, an optionally substituted phenoxy group, an alkoxyl group of 1– 8 carbon atoms, an alkylthio group of 1–8 carbon atoms, or a fluorine atom and b is an integer in the range of 6–10).

Further, in the second embodiment of this invention, the infrared absorbent is preferred to be incorporated in an amount in the range of 0.01–5 parts by weight, based on 100 parts by weight of the binding resin.

In the second embodiment of this invention, the coloring agent mentioned above is preferred to be a coloring agent which produces a color other than black.

In the second embodiment of this invention constructed as described above, the flash fixing toner uses the phthalocyanine type compound represented by the general formula (I) mentioned above as the infrared absorbent to be incorporated therein. The phthalocyanine type compound represented by the general formula (I) has fine affinity for the binding resin used in the flash fixing toner and, when incorporated in the binding resin, readily assumes a solved state or a finely dispersed state. For the reason given above, the condition in which the infrared absorbent is admixed in the binding resin forming the matrix of the toner particles is preferred to be fine for the sake of the flash fixing. In this case, even when the amount of the infrared absorbent to be incorporated is decreased, the infrared absorbent can be expected to manifest fully the inherent function thereof and the toner to afford a satisfactory fixing property. In fact, it has been found that when the phthalocyanine type compound mentioned above is used as contemplated by this invention, the satisfactory fixing property is derived from incorporating this compound in a small amount. Since the phthalocyanine compound is uniformly present in the matrix of the toner, it will emit heat uniformly during the irradiation with flash and will induce neither partial nor defective fixing. The phthalocyanine type compound itself has high resistance to heat. As a result, the irradiation with the flash causes no thermal decomposition on either the infrared absorbent or the binding resin and does not easily pose the problem of imparting voids to the fixed image. Further, since the amount of the infrared absorbent to be incorporated is allowed to be small as described above, the addition of the infrared absorbent in this manner brings about substantially no effect on the tint and the charging property of the toner and proves advantageous economically.

The objects mentioned above are accomplished thirdly by a polymer toner which is obtained by polymerizing a polymerizing monomer composition formed of at least a polymerizing monomer, a coloring agent, and an infrared absorbent and is characterized by the infrared absorbent having the largest absorption wavelength in the range of 750–1100 nm and being incorporated in an amount in the range of 0.01 wt. %–5 wt. %, based on the total amount of the polymerizing monomer composition.

In the third embodiment of this invention, the coloring agent mentioned above is preferred to be a coloring agent which produces a color other than black.

In the third embodiment of this invention, the infrared absorbent is preferred to be contained in the toner particles.

The third embodiment of this invention further concerns a polymer toner for flash fixing which is obtained by polymerizing a polymerizing monomer composition formed of at least a polymerizing monomer, a coloring agent, and an infrared absorbent and is characterized by the infrared absorbent having the largest absorption wavelength in the range of 750–1100 nm and the toner having a volume average particle diameter in the range of 3–15 $\mu$m and a shape factor in the range of 100–160.

In the third embodiment of this invention constructed as described above, since the flash fixing toner is produced by the polymerization method, the toner is easily obtained in the form of small particles having a volume average particle diameter in the approximate range of 3–$\mu$m. Since the toner is in the form of spherical particles having a shape factor in the range of 100–160 or in the form of slightly deformed spherical particles, it can satisfactorily manifest the characteristic feature of enjoying fine flowability and acquiring the high resolution proper for the flash fixing method. Further, since this polymerization method allows the fine dispersion of the infrared absorbent to be attained by any of various methods which are available for the dispersion wished to be attained, the infrared absorbent can be uniformly dispersed finely between the adjacent toner particles and within the toner particles as well. Since the infrared absorbent is incorporated highly efficiently and the infrared absorbent, even when incorporated in a small amount, allows formation of a fixed image at a fixing degree of not less than 70%, therefore, this infrared absorbent thus used enjoys economical advantage, poses no problem of color pollution, and brings about virtually no effect on the charging property.

The objects mentioned above are accomplished fourthly by a polymer toner for flash fixing which is obtained by polymerizing a polymerizing monomer composition formed of at least a polymerizing monomer, a coloring agent, and an infrared absorbent and is characterized by the infrared absorbent having the largest absorption wavelength in the range of 750–1100 nm and the infrared absorbent being solved in the polymerizing monomer composition and being incorporated in an amount in the range of 0.01 wt. %–3 wt. % of the whole amount of the polymerizing monomer composition.

In the fourth embodiment of this invention, the coloring agent mentioned above is preferred to be a coloring agent which produces a color other than black.

The method for the production of the polymer toner according to the fourth embodiment of the invention comprises polymerizing a polymerizing monomer composition formed of at least a polymerizing monomer, a coloring agent, and an infrared absorbent, and characterized by the infrared absorbent having the largest absorption wavelength in the range of 750–1100 nm and the infrared absorbent being solved in the polymerizing monomer composition and being further incorporated in an amount in the range of 0.01 wt. %–3 wt. % of the total amount of the polymerizing monomer composition.

In this method of production, the polymerization mentioned above is preferred to proceed in the form of suspension polymerization.

Further, in this method of production, the solution of the infrared absorption mentioned above in the polymerizing monomer composition is effected by the use of an infrared absorbent which exhibits solubility to the polymerizing monomer. Otherwise, it can be effected by having the infrared absorbent fused and kneaded in advance into a resin exhibiting solubility to the polymerizing monomer and then causing the resin containing the infrared absorbent to be solved in the polymerizing monomer.

Also in the fourth embodiment of this invention constructed as described above, since the flash fixing toner is produced by the polymerization method, the toner is easily obtained in the form of particles of small diameters similarly in the third embodiment. Further, owing to the fact that the toner exhibits satisfactory flowability on account of its spherical shape, the fourth embodiment of the invention can fully manifest the characteristic feature of securing the high resolution which is proper for the flash fixing method. Since the infrared absorbent is solved in the polymerizing monomer composition, the amounts of the infrared absorbent in the toner particles obtained by the polymerization are highly uniform among the toner particles and the physical properties of the individual particles are uniformized. The infrared absorbent is disposed in a solved state or in an extremely finely dispersed state also in the resin which forms the matrix of the toner particles obtained by the polymerization. As a result, the infrared absorbent acts very efficiently and, even when incorporated in a small amount, enables the toner to manifest a fine fixing property exceeding 70% in fixing degree. Since the infrared absorbent, even when incorporated in a small amount as described above, imparts a fine fixing property as aimed at, it enjoys an economic advantage, avoids bringing about the problem of color pollution, and exerts virtually no effect on the charging property.

The objects mentioned above are accomplished fifthly by a polymer toner for flash fixing which is formed by using resin particles obtained by polymerization or further subjecting the resin particles to a coagulating treatment and consequently enabled to contain at least the resin component, a coloring agent, and an infrared absorbent and is characterized by the infrared absorbent being incorporated in the toner by adding it in a polymerization system or in a coagulating treatment system after being subjected to a treatment for fine dispersion and the infrared absorbent having the largest absorption wavelength in the range of 750–1100 nm and being incorporated in an amount in the range of 0.01 wt. %–3 wt. % based on the total amount of the toner.

In the fifth embodiment of this invention, the coloring agent mentioned above is preferred to be a coloring agent which produces a color other than black.

The method for the production of the polymer toner according to the fifth embodiment of this invention is characterized by the infrared absorbent being incorporated in the polymerization system or the coagulating treatment system after being subjected to the treatment for fine dispersion and the infrared absorbent having the largest absorption wavelength in the range of 750–1100 nm and being incorporated in an amount in the range of 0.01 wt. %–3 wt. % based on the total amount of the toner.

The method for the production of the polymer toner according to the fifth embodiment prefers the treatment of the infrared absorbent for fine dispersion to be performed on the polymerizing monomer, a solvent, an aqueous medium, or a resin soluble in the polymerizing monomer.

In the fifth embodiment of this invention constructed as described above, since the flash fixing toner is produced by the polymerization method, it excels in flowability and is capable of fully manifesting the characteristic feature of acquiring high resolution proper for the flash fixing method. Further, since the infrared absorbent is incorporated in the toner after it has undergone the treatment for fine dispersion, it can be uniformly dispersed finely between the adjacent toner particles and within the individual toner particles. The infrared absorbent to be used in this invention has the largest absorption wavelength in the range of 750–1100 nm and can absorb the xenon flashlight efficiently. Since the infrared absorbent is incorporated highly efficiently and the infrared absorbent, even when incorporated in a small amount, allows fully satisfactory fixing. This infrared absorbent thus used, therefore, enjoys economical advantage, poses no problem of color pollution, and brings about virtually no effect on the charging property. Further, the method for the production according to the fifth embodiment of this invention enables even the infrared absorbent which has not been easily used by the conventional pulverizing method on account of the occurrence of defective dispersion to be finely dispersed with fully satisfactory results.

DETAILED DESCRIPTION OF PREFERRED EMBODIMENT OF THE INVENTION

Now, this invention will be described more specifically below with reference to working examples.

1. Binding resin

The binding resin to be used in the flash fixing toner of this invention imposes no particular restriction. As concrete examples of the binding resin effectively usable herein, polystyrenes, styrene-containing copolymers formed of styrene with (meth)acrylic esters, acrylonitrile, or maleic esters, poly(meth)acrylic esters, polyesters, polyamides, epoxy resins, phenol resins, hydrocarbon resins, and petroleum type resins may be cited. Among other resins mentioned above, polyester resins and epoxy resins of bisphenol A/epichlorohydrin prove particularly preferable. These resins may be used either singly or in the form of a mixture of two or more members. Optionally, they may be used in combination with other resins or additives.

2. Polymerizing monomer

The flash fixing toner of this invention can be produced by the polymerization method. The polymerizing monomer to be used in this case imposes no particular restriction and only requires to be polymerizable by the method which is capable of forming a suspension polymer, an emulsion polymer, or a dispersion polymer in the shape of minute spherical particles. Various kinds of vinyl monomers such as, for example, styrene type monomers including styrene, o-methylstyrene, m-methylstyrene, p-methyl-styrene, a-methylstyrene, p-methoxystyrene, p-tert-butylstyrene, p-phenylstyrene, o-chlorostyrene, m-chlorostyrene, and p-chloro-styrene; (meth) acrylic ester type monomers including methyl acrylate, ethyl acrylate, n-butyl acrylate, isobutyl acrylate, dodecyl acrylate, stearyl acrylate, 2-ethylhexyl acrylate, tetra-hydrofurfuryl actylate, methyl methacrylate, ethyl methacrylate, propyl methacrylate, n-butyl methacrylate, isobutyl methacrylate, n-octyl methacrylate, dodecyl methacrylate, 2-ethylhexyl methacrylate, and stearyl methacrylate, olefin type monomers including ethylene, propylene, and butylene, and acrylic acid, methacrylic acid, vinyl chloride, vinyl acetate, acrylonitrile, acrylamide, methacrylamide, and N-vinyl pyrrolidone which are generally used in the field of toners can be used either singly or in the form of a mixture of two or more members.

When such vinyl monomers are wished to have a cross-linking structure interposed between the adjacent monomer units, aromatic divinyl compounds such as divinyl benzene, divinyl naphthalene, and derivatives thereof, diethylenically unsaturated carboxylic esters such as ethylene glycol dimethacrylate, triethylene glycol dimethacrylate, trimethylol propane triacrylate, allyl methacrylate, t-butyl aminoethyl methacrylate, tetraethylene glycol dimethacrylate, and 1,3-butane dimethacrylate, all the divinyl compounds such as N,N-divinyl aniline, divinyl ether, divinyl sulfide, and divinyl sulfonic acid, and compounds having not less than three vinyl groups can be added as a cross-linking component. Further, polybutadiene, polyiroprene, unsaturated polyesters, and chlorosulfonated polyolefins are effectively usable.

The polymerizing monomer composition may incorporate therein a (co)polymer similar in composition to the polymerizing monomer or other (co)polymer such as, for example, styrene type resin, styrene acrylate type resin, rosin derivative, aromatic petroleum resin, pinene type resin, epoxy type resin, and coumarone type resin for the purpose of uniformizing the particle diameter distribution thereof. The polymers mentioned herein impose no particular restriction. Properly, they have weight average molecular weights in the approximate range of 500–100000, preferably 1000–50000. The amount of such a (co)polymer to be incorporated is proper in the approximate range of 0–50 parts by weight, based on 100 parts by weight of the polymerizing monomer.

3. Coloring agent

The coloring agent contemplated by this invention may be any of the conventionally known coloring agents such as, for example, pigments or dyes like black coloring agents including carbon black, furnace black, and acetylene black, yellow coloring agents including chrome yellow, cadmium yellow, yellow iron oxide, titan yellow, naphthol yellow, Hanza yellow, pigment yellow, benzidine yellow, permanent yellow, quinoline yellow, and anthrapyrimidine yellow, orange coloring agents including permanent orange, molybdenum orange, valcan fast orange, benzine orange, and indanthrene brilliant orange, brown coloring agents including iron oxide, amber, and permanent brown, red coloring agents including iron oxide red, rose iron oxide red, antimony powder, permanent red, fire red, brilliant carmine, light fast red toner, permanent carmine, pyrazolone red, Bordeaux, helio-Bordeaux, rhodamine lake, DuPont oil red, thioindigo red, thioindigo maron, and watching red strontium, purple coloring agents including cobalt purple, fast violet, dioxane violet, and methyl violet lake, blue coloring agents including methylene blue, aniline blue, cobalt blue, cerulean blue, chalco oil blue, nonmetal phthalocyanine blue, phthalocyanine blue, ultramarine blue, indanthrene blue, and indigo, and green coloring agents including chrome green, cobalt green, pigment green B, green gold, phthalocyanine green, malachite green oxalate, and polychromo-bromo copper phthalocyanine. These pigments or dyes may be used either singly or in the form of a mixture of two or more members.

Incidentally, since the flash fixing toner of this invention has been improved in flash fixing property by the incorporation of the infrared absorbent, the color toner using a coloring agent producing a color other than black manifests a particularly great effect.

Though the coloring agent is not particularly discriminated on account of the amount thereof to be used herein, it is preferred to be incorporated in an amount in the range of 3–15 parts by weight, based on 100 parts by weight of the binding resin in the toner composition.

4. Infrared absorbent

The flash fixing toner of the present invention further incorporates therein the infrared absorbent. The infrared absorbent to be used in the flash fixing toner of this invention is suitably selected so as to be uniformly dispersed in the toner particles to be obtained. When the flash fixing toner according to this invention is elected to be produced by the polymerization method, it has a relatively high degree of freedom of selection and can be selected from a wide range. When it is elected to be produced by the pulverizing method, it is preferred to be soluble in the binding component of the toner.

4-1. Infrared absorbent soluble in binding resin

The infrared absorbent to be used in the first embodiment of this invention has the largest absorption wavelength in the range of 750–1100 nm, preferably 800–1100 nm. In the flash fixing toner of the first embodiment of this invention, the infrared absorbent is retained in a solved state in the binding resin. When the infrared absorbent is solved in the binding resin, the infrared absorbent disposed in the binding resin is dispersed on the molecular level and, consequently, is enabled to manifest satisfactorily the ability inherent in itself. Even when the infrared absorbent is incorporated in only a small amount, therefore, it can be effectively solved by the action of emitting heat during the process of flash fixing.

For the purpose of causing the infrared absorbent to assume a solved state in the binding resin, a method which consists in selectively using the infrared absorbent which is inherently soluble in the binding resin or a method which consists in using a resin capable of solving the infrared absorbent as a phase solubility enhancer is available.

As a means to rate the state of solution of the infrared absorbent in the resin, a method for measuring the turbidity of the resin containing the infrared absorbent is available. The magnitude of the turbidity reported in the present specification is the result obtained by adding to 100 parts by weight of a given binding resin (including a phase solubility enhancer when the resin happens to contain one) 0.1 part by weight of a given infrared absorbent, melting and kneading them together by the use of a Labplast Mill at 120° C. for 10 minutes, molding the resin containing the infrared absorbent into a film, 0.3 mm in thickness, and measuring this film for turbidity with a turbidometer (made by Nippon Denshoku Kogyo K. K. and commercialized under the product code of "ND-1000DP").

The present invention prefers the infrared absorbent to be selected such that this infrared absorbent, when incorporated in a binding resin wished to be used, exhibits turbidity of not more than 10%, preferably not more than 8%. If this turbidity exceeds 10%, the amount of the infrared absorbent to be incorporated will have to be increased for enabling the produced toner to manifest a satisfactory fixing property during the course of flash fixing and the increase in this amount will possibly exert an adverse effect on the toner tint, charging property, etc. of the infrared absorbent and render the infrared absorbent very unfavorable in terms of cost.

Though it is difficult to cite generally concrete examples of the infrared absorbent to be used in this invention because the solubility of the infrared absorbent varies with the kind of binding resin to be used, (a) the infrared absorbents of the cyanine compound type, diimonium compound type, and ammonium compound type or (b) the Ni complex compound type, phthalocyanine compound type, anthraquinone compound type, and naphthanocyanine compound type incorporating therein such a functional group as shown below for the sake of improving solubility can be used.

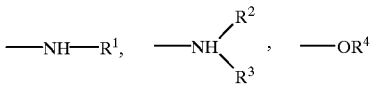

(wherein $R^1$–$R^4$ independently stand for a C1–C20 alkyl group, phenyl group, tolyl group, xylyl group, naphthyl group, ethyiphenyl group, propylphenyl group, butylphenyl group, or naphthyl group).

Incidentally, of the phthalocyanine type compounds to be enumerated in Subsection 4.2 herein below, those which exhibit solubility to a relevant binding resin can be advantageously used.

The flash fixing, unlike the heat roll fixing, effects the fixing of a relevant toner by the fact that the toner emits heat on absorbing the light issuing from a xenon flash lamp (mainly a near infrared light, 800 nm–1100 nm in wavelength) and, therefore, causes the toner to reach a temperature in the approximate range of 300° C.–600° C., though instantaneously. If the temperature at which the infrared absorbent begins thermal decomposition, or the heat resistance temperature of the infrared absorbent, is unduly low, the decomposition gas of the infrared absorbent will possibly cause occurrence of voids in the fixed image. The heat resistance temperature of the infrared absorbent, therefore, is preferably not lower than 230° C., more preferably not lower than 250° C., and most preferably not lower than 300° C.

In the flash fixing toner according to the first embodiment of this invention, the amount of the infrared absorbent to be incorporated is set in the approximate range of 0.01 wt. %–1 wt. %, based on the total amount of the toner composition. The reason for this range is that the toner will possibly fail to acquire easily a satisfactory fixing property notwithstanding the infrared absorbent is solved in the binding resin and dispersed on the molecular level therein if the amount is less than 0.01 wt. % and that the infrared absorbent in excess supply will not only prove unfavorable economically but also incur the possibility of exerting an adverse effect on the tint, charging property, etc. of the toner if the amount exceeds 1 wt. %.

4-2. Preferred phthalocyanine type infrared absorbent

The flash fixing toner according to the second embodiment of this invention a compound represented by the following general formula (I) as the infrared absorbent.

(I)

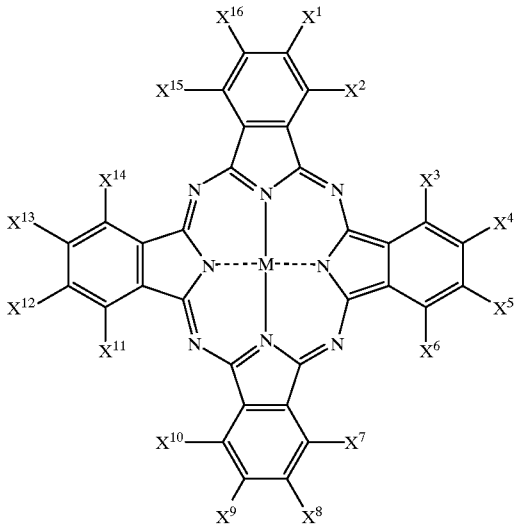

(wherein at least one of the substituents, $X^1$–$X^{16}$, is NH-R (wherein R is an alkyl group of 1–8 carbon atoms or an optionally substituted aryl group, preferably optionally substituted phenyl group) and M is a nonmetal, metal, metal oxide, metal carbonyl, or metal halide).

The metal denoted by M in the compound represented by the general formula (I) preferably embraces copper, zinc, cobalt, nickel, iron, vanadium, titanium, indium, aluminum, tin, gallium, and germanium, for example, the metal halide denoted by M likewise preferably embraces fluoride, chloride, bromide, etc., the central atom or atomic group denoted by M likewise preferably embraces copper, zinc, cobalt, nickel, iron, vanadyl, titanyl, chloroindium, tin chloride, gallium chloride, dichlorogermanium, indium iodide, aluminum iodide, gallium iodide, cobalt carbonyl, and iron carbonyl, particularly vanadyl or tin chloride.

In the general formula (I), the aromatic ring of the phthalocyanine skeleton properly contain in the substituents denoted by $X^1$–$X^{16}$ at least one, preferably three or more, and particularly preferably four to 10 NH—R groups.

As concrete examples of the NH—R substituent, alkyl amino groups such as methyl amino, ethyl amino, p-propyl amino, isopropyl amino, n-butyl amino, isobutyl amino, tert-butyl amino, n-pentyl amino, and n-octyl amino and aryl amino or substituted aryl amino groups such as anilino, o-toluidino, p-toluidino, m-toluidino, 2,4-xylydino, 2,6-xylydino, 2,4-ethyl anilino, 2,6-ethyl anilino, o-methoxy anilino, p-methoxy anilino, m-methoxy anilino, o-ethoxy anilino, p-ethoxy anilino, m-ethoxy anilino, 2,4-ethoxy anilino, 2,6-ethoxy anilino, o-fluoro anilino, p-fluoro anilino, tetrafluoro anilino, and p-ethoxycarbonyl anilino may be cited.

Other substituents which are allowed to occur as the substituents denoted by $X^1$–$X^{16}$ in the general formula (I) include hydrogen atom, halogen atoms, and compounds represented by the formulas (1)

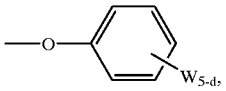

(2)

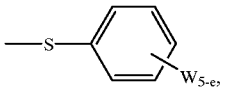

(3)

$$—OR^1,$$

(4)

$$—SR^2$$

(wherein $R^1$ and $R^2$ independently denote an alkyl group of 1–8 carbon atoms, W denotes a hydrogen atom, an alkyl group of 1–4 carbon atoms, an alkoxyl group of 1–4 carbon atoms, or a halogen atom, and d and e independently denote an integer of 1–5).

Here, the alkyl group of 1–4 carbon atoms means methyl group, ethyl group, n-propyl group, isopropyl group, n-butyl group, isobutyl group, and tert-butyl group. The alkyl group of 1–8 carbon atoms means a straight chain or branched pentyl group, straight chain or branched hexyl group, straight chain or branched heptyl group, and straight chain or branched octyl group in addition to the alkyl groups just mentioned. The alkoxyl group of 1–4 carbon atoms means methoxyl group, ethoxyl group, n-propoxyl group, n-butoxyl group, isobutoxyl group, and tert-butoxyl group. The acyl group of 1–4 carbon atoms means formyl group, acetyl group, propionyl group, butyryl group, and isobutyryl group.

The halogen atoms as other substitutents include fluorine atom, chlorine atom, bromine atom, iodine atom, etc. for example. Among other halogen atoms mentioned above, fluorine atom and chlorine atom prove preferable and fluorine atom proves particularly preferable. By having the substituent of fluorine atom, the relevant compound can be expected to enjoy improvement in solubility.

As concrete examples of the substituent represented by the general formula (1) covering other substituents, phenoxy, o-methyl-phenoxy, o-methoxy-phenoxy, o-fluoro-phenoxy, tetrafluoro-phenoxy, p-methyl-phenoxy, p-fluoro-phenoxy, etc. may be cited.

As concrete examples of the substituent represented by the general formula (2) covering other substituents, phenylthio, o-methyl-phenylthio, o-methoxy-phenylthio, o-fluoro-phenylthio, tetrafluoro-phenoxylthio, p-methyl-fluorothio, etc. may be cited.

As concrete examples of the substituent represented by the general formula (3) covering other substituents, methoxy, ethoxy, p-propyloxy, isopropoxy, n-butoxy, isobutoxy, tert-butoxy, n-pentyloxy, n-octyloxy, etc. may be cited.

As concrete examples of the substituent represented by the general formula (4) covering other substituents, methylthio, ethylthio, p-propylthio, isopropylthio, n-butylthio, isobtylthio, tert-butylthio, n-pentylthio, n-octylthio, etc. may be cited.

The phthalocyanine type compound represented by the general formula (I), as described above, properly contains in the substituents, $X^1$–$X^{16}$, at least one, preferably three or more, and particularly preferably 4–10 substituents represented by NH—R. Further, it properly has vanadyl or tin chloride for the central atom or central atomic group denoted by M in the general formula (I). More properly, all the rest of the positions for substitution in the substituents represented by NH-R have substituents represented by the general formulas (1), (2), (3), or (4) mentioned above. The fact that the phthalocyanine type compound has substituents represented by NH—R and the fact that the central metal M is VO or SnCl2 can be expected to improve the solubility of the phthalocyanine type compound to the binding resin and shift the largest absorption peak in the range of wavelength of 750–1100 nm toward the greater wavelength side. Particularly the fact that some of the substituents mentioned above are fluorine atoms or the substituents represented by the general formulas (1), (2), (3), or (4) mentioned above can be expected to improve the solubility or shift the largest absorption peak toward the greater wavelength side. Naturally, however, the substituents (excluding hydrogen atom) mentioned above can invariably contribute to the improvement of the solubility to the binding resin and to the shift of the largest absorption peak in the range of wavelength of 750–1100 nm toward the greater wavelength side.

More properly, the phthalocyanine compound represented by the general formula (I) is preferred to be what is represented by the general formula (II) or (III) shown below. The compounds of the general formula (III) are preferred over those of the general formula (II).

(II)

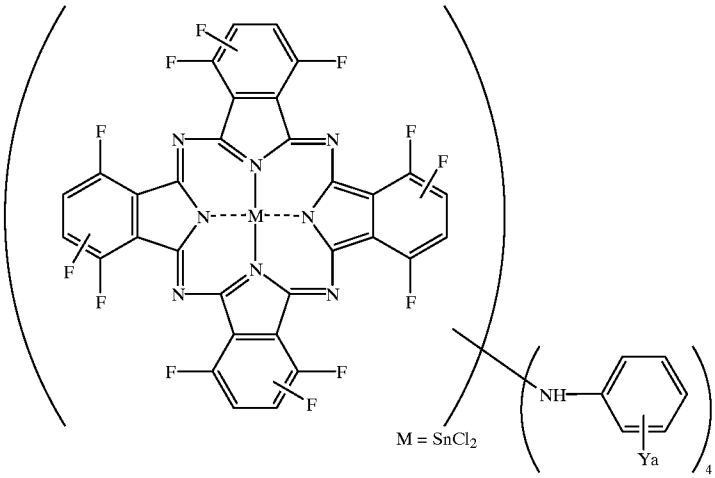

(wherein Y denotes an alkyl or alkoxyl group of 1–4 carbon atoms and a denotes 1 or 2)

The infrared absorbent which is formed of the phthalocyanine type compound represented by the general formula (III)

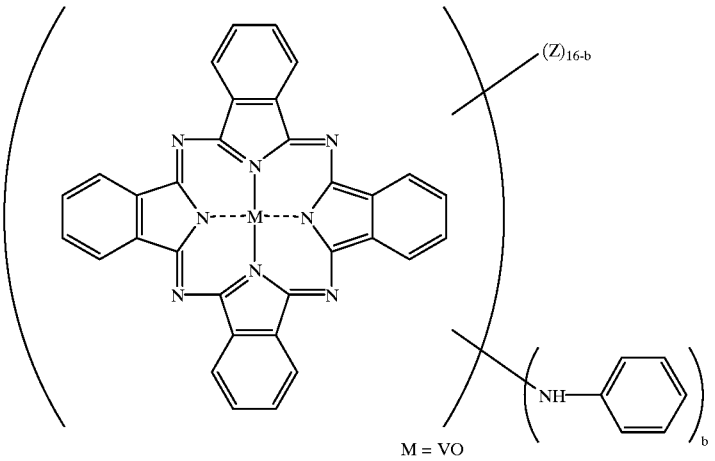

(wherein Z denotes an optionally substituted phenylthio group, optionally substituted phenoxy group, alkoxyl group of 1–8 carbon atoms, alkylthio group of 1–8 carbon atoms, or fluorine atoms, preferably fluorine atom, and b denotes an integer of 6–10).

To illustrate, only partly, preferred concrete examples of the phthalocyanine type compound represented by the general formula (I), octakis-(anilino) -octafluoro vanadyl phthalocyanine, octakis(anilino)-octakis(phenylthio) vanadyl phthalocyanine, 4-tetrakis(anilino)-3,5,6-dodecafluoro-tin chloride phthalocyanine, 4-tetrakis (o-ethoxyanilino)-3,5,6-dodecafluoro-tin chloride phthalocyanine, 4-tetrakis (2,6-ethylanilino)-3,5,6-dodecafluoro-tin chloride phthalocyanine, and 4-tetrakis(2, 4-dimethoxy-anilino)-3,5,6-dodecafluoro-tin chloride phthalocyanine may be cited. Incidentally, in the designation of these compounds, the 4 and 5 positions of substitution in the matric configuration indicate the substituents of $X^1$, $X^4$, $X^5$, $X^8$, $X^9$, $X^{12}$, $X^{13}$, and $X^{16}$ in the general formula (I) and the 3 and 6 positions likewise indicate the substituents of $X^2$, $X^6$, $X^7$, $X^{10}$, $X^{14}$, and $X^{15}$ in the general formula (I).

(I) mentioned above exhibits fine compatibility to the binding resin and assumes a solved state or finely dispersed state in the binding resin. Since the infrared absorbent incorporated in the binding resin is eventually dispersed on a molecular level therein when the infrared absorbent is solved in the binding resin, it can fully manifest the ability inherent therein and, even when incorporated only in a small amount, can permit effective solution of the binding resin owing to the action of emitting heat during the course of the flash fixing.

Though the phthalocyanine type compound contemplated by this invention and represented by the general formula (I) exhibits fine compatibility with the binding resin, it is allowed, when necessary, to incorporate therein as a phase solubility enhancer such a resin as exhibits still better compatibility with the phthalocyanine type compound.

The phthalocyanine type compound of the general formula (I) to be used as an infrared absorbent in the second embodiment of this invention is preferred to be such that the phthalocyanine type compound, when incorporated in the binding resin elected to be used, registers turbidity of not more than 10%, preferably not more than 8% as determined by the method described above. The reason for this upper limit is that if the turbidity exceeds 10%, the amount of the infrared absorbent to be incorporated will have to be increased for the purpose of obtaining a satisfactory fixing property during the course of flash fixing and this increase in the amount will possibly cause the infrared absorbent to exert an adverse effect on the tint, charging property, etc. of the toner and prove highly unfavorable in terms of cost.

The phthalocyanine type compound of the general formula (I) which is used as the infrared absorbent is required, for the reason given above, to have a heat resistance temperature of not lower than 300° C., preferably not lower than 350° C.

In the flash fixing toner of this invention, the amount of the infrared absorbent to be incorporated therein is set at a ratio in the range of 0.01 wt. %–5 wt. %, preferably 0.01 wt. %–1 wt. %, based on the total amount of the toner composition. The reason for this range is that the infrared absorbent, even when solved and dispersed on a molecular level in the binding resin, will incur the great possibly of failing to acquire easily a satisfactory fixing property if the amount is less than 0.01 wt. % and that the infrared absorbent in excess supply, though producing no problem whatever in terms of the fixing property, will not only prove unfavorable economically but also incur the possibility of exerting an adverse effect on the tint, charging property, etc. of the toner if the amount exceeds 5 wt. %.

4-3. Infrared absorbent used for polymerization method

The infrared absorbent to be used in the third embodiment of this invention imposes no particular restriction and only requires to have the largest absorption wavelength in the range of 750–1100 nm as described above. As concrete examples of the infrared absorbent which answer this description, cyanine compound, diimonium compound, aminium compound, Ni complex compound, phthalocyanine compound, anthraquinone compound, and naphthalocyanine compound may be cited.

Specifically, Kayasoub IR-750, IRG-002, IRG-003, IRG-22, IRG-023, IR-820, CY-2, CY-4, CY-9, CY-10, CY-17, CY-20, etc. made by Nippon Kayaku Co., Ltd., and bis(1, 2'-diphenylecene-1,2-dioctyl) nickel, octakis(anilino) octakis(phenylthio)vanadyl phthalocyanine, octakis(anilino) octafluorovanadyl phthalocyanine, and 4-tetrakis(anilino)-3, 5,6-dodecafluoro-tin chloride phthalo-cyanine are cited. Incidentally, the other compounds already cited as concrete examples of the infrared absorbents for use in the first and the second embodiment mentioned above are favorably usable.

In the flash fixing toner of the third embodiment of this invention, the amount of the infrared absorbent to be incorporated is set at a ratio in the range of 0.01 wt. %–5 wt. %, preferably 0.01 wt. %–3 wt. %, based on the amount of the polymerizing monomer. The reason for this range is that the infrared absorbent, even when dispersed satisfactorily in the toner particles obtained in consequence of the polymerization of the polymerizing monomer, will incur the great possibility of failing to acquire easily a satisfactory fixing property if the amount is less than 0.01 wt. % and that the infrared absorbent in excess supply, though producing no problem whatever in terms of the fixing property, will not only prove unfavorable economically but also incur the possibility of exerting an adverse effect on the tint, charging property, etc. of the toner if the amount exceeds 5 wt. %.

The time and the method for the incorporation of the infrared absorbent into the polymerizing monomer composition are not specifically restricted and the method for the dispersion or solution of the infrared absorbent in the polymerizing monomer is not specifically restricted. The methods to be selected are nevertheless preferred to be such that the infrared absorbent may be allowed to occur in the produced toner particles uniformly between and within the toner particles.

These methods may resort to such dispersing devices as, for example, a ball mill, paint shaker, sand mill, colloid mill, attriter, kneader, and three rolls.

4-4. Infrared absorbent soluble in polymerizing monomer composition.

The infrared absorbent to be used in the fourth embodiment of this invention imposes no particular restriction but only requires to have the largest absorption wavelength in the range of wavelength of 750–1100 nm and exhibit solubility to the polymerizing monomer composition as described above.

For the purpose of solving the infrared absorbent in the polymerizing monomer composition, the simplest method of solving the infrared absorbent in the polymerizing monomer or the method of solving the infrared absorbent by the actions of solving and kneading in advance in the resin destined to solve in the polymerizing monomer is available. When the infrared absorbent is solved and kneaded in advance in the resin destined to solve in the polymerizing monomer and then the resin containing the infrared absorbent is incorporated and solved in the polymerizing monomer, the infrared absorbent which inherently has no or only low solubility to the polymerizing monomer is enabled to be solved in the polymerizing monomer by the fact that the resin manifests an action like a surfactant.

The expression "the infrared absorbent is solved in the polymerizing monomer composition" as used in this invention does not need to be limited to the use of an infrared absorbent which inherently has solubility in the polymerizing monomer but may embrace all manners of causing the infrared absorbent to be solved by the action of one substance or other and consequently enabled to assume a solved state in the polymerizing monomer.

Though it is generally difficult to cite concrete examples of the infrared absorbent which can be used in the fourth embodiment of this invention because the solubility of this infrared absorbent is varied with the kind of polymerizing monomer to be used and the kind of resin to be solved in the polymerizing monomer, the compounds such as, for example, the cyanine compounds, diimmonium compounds, aminium compounds, Ni complex compounds, phthalocyanine compounds, anthraquinone compounds, and naphthalocyanine compounds which have incorporated therein such functional groups as shown below for the purpose of improving the solubility thereof may be cited.

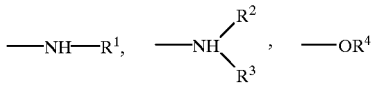

(wherein $R^1$–$R^4$ independently denote a C1–C20 alkyl group, phenyl group, tolyl group, xylyl group, naphthyl group, ethyl-phenyl group, propyl phenyl group, butyl phenyl group, or naphthyl group).

As concrete examples, Kayasoub IRG-002 and IRG-003 made by Nippon Kayaku Co., Ltd., and octakis (anilino) octakis (phenylthio) -vanadyl phthalocyanine, octakis (anilino)octafluorovanadyl phthalocyanine, and 4-tetrakis (anilino)-3,5,6-dodecafluoro-tin chloride phthalocyanine may be cited.

Properly, the heat resistance temperature of the infrared absorbent is not lower than 230° C., preferably not lower than 250° C., and most preferably not lower than 300° C. as described above.

In the flash fixing polymer toner according to the fourth embodiment, the amount of the infrared absorbent to be incorporated is properly in the range of 0.01 wt. %–3 wt. %, preferably 0.01 wt. %–2 wt. %, based on the amount of the polymerizing monomer composition. The reason for this range is that the infrared absorbent, even when solved and dispersed on a molecular level in the resin forming the matrix within the ultimately obtained toner particles, will incur great possibility of failing to acquire easily a satisfactory fixing property if the amount is less than 0.01 wt. % and that the infrared absorbent in excess supply, though producing no problem whatever in terms of the fixing property, will not only prove unfavorable economically but also incur the possibility of exerting an adverse effect on the tint, charging property, etc. of the toner if the amount exceeds 3 wt. %.

4-5. Infrared absorbent insoluble in Polymerizing monomer composition

The infrared absorbent to be used in the fifth embodiment of this invention imposes no particular restriction but only requires to have the largest absorption wavelength in the range of 750–1100 nm as mentioned above and to be dispersible and not soluble in the polymerizing monomer, solvent, aqueous medium, resin, etc.

Though it is generally difficult to cite concrete examples of the infrared absorbent which can be used in this invention because the solubility of this infrared absorbent is varied with the polymerizing monomer, solvent, aqueous medium, resin, etc. intended to treat the relevant infrared absorbent for fine dispersion and their kinds, the cyanine compounds, diimmonium compounds, aminium compounds, Ni complex compounds, phthalo-cyanine compounds, anthraquinone compounds, and naphthalocyanine compounds may be cited.

Specifically, Kayasoub IR-750, IRG-022, IRG-023, IR-820B, CY-2, CY-4, CY-9, CY-17, and CY-20 made by Nippon Kayaku Co., Ltd. and bis(1,2'-diphenylecene-1,2-dithiol) nickel may be cited.

For the reason given above, the heat resistance temperature of the infrared absorbent is preferably not lower than 230° C., more preferably not lower than 250° C., and most preferably not lower than 300° C.

In the flash fixing electrophotographic toner according to the fifth embodiment of this invention, the amount of the infrared absorbent to be incorporated is in the range of 0.01 wt. %–3 wt. %, preferably 0.01 wt. %–2 wt. %, based on the total weight of the ultimately obtained toner composition. The reason for this range is that the infrared absorbent, even when finely dispersed satisfactorily within the produced toner particles, will incur great possibility of failing to acquire easily a satisfactory fixing property if the amount is less than 0.01 wt. % and that the infrared absorbent in excess supply, though producing no problem whatever in terms of the fixing property, will not only prove unfavorable economically but also incur the possibility of exerting an adverse effect on the tint, charging property, etc. of the toner if the amount exceeds 3 wt. %.

5. Other additives

The flash fixing toner of this invention is allowed to incorporate further therein a waxy component, a charge controlling agent, an agent for imparting flowability, etc. as occasions.

Polyolefin type wax and natural wax can be used as the waxy component. As concrete examples of the polyolefin type wax, polyethylene, polypropylene, polybutylene, ethylene-propylene copolymer, ethylene-butene copolymer, ethylene-pentene copolymer, ethylene-3-methyl-1-butene copolymer, and copolymers of olefins with other monomers such as, for example, vinyl esters, haloolefins, (meth)acrylic esters, and (meth) acrylic acid or derivatives thereof may be cited. The weight average molecular weight of the waxy component is preferred to be in the approximate range of 1000–45000. As concrete examples of the natural wax, carnauba wax, montan wax, and natural paraffins may be cited.

As concrete examples of the charge controlling agent, nigrosine, monoazo dyes, zinc, hexadecyl succinate, alkyl esters or alkyl amides of naphthoic acid, nitrohumic acid, N,N-tetramethyl diamine benzophenone, N,N-tetramethyl benzidine, triazine, and salicyl acid metal complexes may be cited. When the coloring agent to be used in the flash fixing toner of this invention is in the form of a color toner producing a color other than black, the charge controlling agent is preferred to have no color or a light color.

As concrete examples of the agent for imparting flowability, minute particles of such inorganic substances as colloidal silica, hydrophobic silica, hydrophobic titania, hydrophobic zirconia, and talc and minute particles of such organic substances as polystyrene beads and (meth) acryl resin beads may be cited.

6. Method of Production 6-1.

The method for the production of the flash fixing toner of the first embodiment of this invention which uses an infrared absorbent which is soluble in the relevant binding resin as stated in Subsection 4-2 above imposes no particular restriction but only requires to permit production of toner particles having the infrared absorbent in a solved state in the binding resin. A solving and kneading method which obtains toner particles by compounding such additives as binding resin, coloring agent, and infrared absorbent and other necessary components mentioned above in severally prescribed amounts, solving and kneading them together, then cooling and pulverizing the resultant mixture, and classifying the produced particles, a suspension polymerization method which obtains toner particles by preparing a polymerizing composition by compounding a monomer capable of forming a binding resin by polymerization with a coloring agent, an infrared absorbent, etc., suspending the polymerizing composition in an aqueous medium, and then polymerizing the monomer mentioned above, and various methods heretofore known to the art are available for the production.

6-2.

The method for the production of the flash fixing toner according to the second embodiment of this invention by the use of a phthalocyanine type compound represented by the general formula (I) already described in Subsection 4-2 imposed no particular restriction. The solving and kneading method, suspension polymerization method, and various other known methods are available for the production.

6-3.

The method for the production of the flash fixing toner according to the third embodiment of this invention which permits use of an infrared absorbent selected with relatively high arbitrariness as stated already in Subsection 4-3 only requires to be a polymerization method which is capable of obtaining a polymer in the form of minute spherical particles. For example, the production can be attained by polymerizing a polymerizing monomer composition obtained by compounding a polymerizing monomer with a coloring agent, infrared absorbent and further with such additives as waxy component, charge controlling agent, and agent for imparting flowability based on the suspension polymerization method, emulsion polymerization method, or dispersion polymerization method.

As concrete examples of the dispersant or emulsifier to be used in the suspension polymerization, dispersion polymerization, and emulsion polymerization, macromolecular dispersants such as polyvinyl alcohol, gelatin, tragacanth, starch, methyl cellulose, carboxy methyl cellulose, hydroxyethyl cellulose, sodium polyacrylate, sodium polymethacrylate, and polyvinyl pyrrolidone, surfactants such as sodium dodecyl benzene sulfonate, sodium tetradecyl sulfate, sodium pentadecyl sulfate, sodium octyl sulfate, sodium aryl-alkyl-polyethersulfonate, sodiumoleate, sodiumlaurate, sodium caprylate, sodium caproate, sodium stearate, potassium oleate, sodium 3,3'-disulfone diphenyl urea-4,4'-diazo-bis-amino-8-naphthol-6-sulfonate, ortho-carboxy-benzene-azo-dimethyl aniline, sodium 2,2',5,5'-tetramethyl-triphenyl methane-1,1'-diazo-bis-β-naphthol-disulfonate, sodium alkylnaphthalene sulfonate, sodium dialkylsulfosuccinate, sodium alkyldiphenyl ether disulfonate, sodium polyoxyethylene alkyl sulfate, polyoxyethylene alkylether sulfuric acid triethanol amine, ammonium polyoxyethylene alkylphenyl ether sulfate, sodium alkylsulfonate, sodium salt of β-naphthalene sulfonic acid-formalin condensate, sodium salt of special aromatic sulfonic acid-formalin condensate, special carboxylic acid type macromolecular surfactants, polyoxyethylene lauryl ether, polyoxyethylene cetyl ether, polyoxyethylene stearyl ether, polyoxyethylene octylphenyl ether, polyoxyethylene nonylphenyl ether, polyoxyethylene sorbitan alkylate, lauryl trimethyl ammonium chloride, stearyl trimethyl ammonium chloride, cetyl trimethyl ammonium chloride, distearyl dimethyl ammonium chloride, and alkylbenzyl dimethyl ammonium, and alginates, zein, casein, barium sulfate, calcium sulfate, barium carbonate, magnesium carbonate, calcium phosphate, talc, clay, diatomaceous earth, bentonite, titanium hydroxide, sodium hydroxide, and metal oxide powders may be cited.

As the polymerization initiator to be used for polymerization, oil soluble peroxide type or azo type initiators which are normally intended for suspension polymerization and dispersion polymerization are available. As concrete examples of the polymerization initiator, peroxide type initiators such as benzoyl peroxide, lauroyl peroxide, octanoyl peroxide, benzoyl orthochloroperoxide, benzoyl orthomethoxyperoxide, methylethyl ketone peroxide, diisopropyl peroxy dicarbonate, cumene hydro-peroxide, cyclohexanone peroxide, t-butyl hydroperoxide, and diisopropyl benzene hydroperoxide, 2,2'-azobisisobutyronitrile, 2,2'-azobis(2,4-dimethyl valeronitrile), 2,2'-azobis(2,3-dimethyl butyronitrile), 2,2'-azobis(2-methylbutyronitrile), 2,2'-azobis(2,3,3-trimethylbytyronitrile), 2,2'-azobis(2-isopropyl butyronitrile), 1,1'-azobis(cyclohexane-1-carbonitrile), 2,2'-azobis(4-methoxy-2,4-dimethyl valeronitrile), 2-(carbamoylazo)-isobutyronitrile, 4,4'-azobis(4-cyanovaleric acid), and dimethyl-2,4'-azobisisobutyrate may be cited. As concrete examples of the water-soluble initiator to be used for emulsion polymerization, persulfates such as sodium persulfate, potassium persulfate, and ammonium persulfate, organic peroxides such as tertiary isobutyl hydroperoxide, cumene hydroperoxide, and paramenthane hydro-peroxide, and hydrogen peroxide may be cited. The polymerization initiator is properly used in an amount in the range of 0.01–20 wt. %, preferably 0.1–10 wt. %, based on the amount of the polymerizing monomer.

The method for the production of the toner according to suspension polymerization, for example, is a method which obtains toner particles by suspending in an aqueous medium a polymerizing monomer composition formed of a polymerizing monomer, infrared absorbent, coloring agent, and polymerization initiator, and optionally a charge controlling agent and a waxy component, polymerizing the monomer in the composition, and then filtering, cleaning, and drying the reaction product. Incidentally, in the preparation of the polymerizing monomer composition, such additives as infrared absorbent and coloring agent may be finely dispersed by the use of a ball mill, for example. The method, when necessary, may incorporate in the course of process a step of removing the suspension dispersant, a step of subjecting the polymer particles to a treatment for agglomeration, or a step of disintegrating the lumps of polymer particles.

The method for the production of the toner by dispersion polymerization, for example, is a method which obtains toner particles by using as a medium a solvent compatible with the polymerizing monomer and incompatible with the polymer, adding the same polymerizing monomer composition as mentioned above to this medium, polymerizing the monomer in the composition, and then filtering, washing, and drying the reaction product. This method, similarly to the suspension polymerization method, is allowed to incorporate therein a step of removing the dispersant, a step of agglomerating polymer particles, and a step of disintegrating lumps of polymer particles.

The method for the production of the toner by emulsion polymerization, for example, is a method which obtain toner particles by placing such additives as infrared absorbent and coloring agent in the emulsion polymer solution obtained by emulsion polymerizing a polymerizing monomer composition, finely dispersing the additives in the solution, and subjecting the resultant suspension to a treatment for agglomeration. This method, similarly to the suspension polymerization method, is allowed to incorporate in the process thereof a step of removing the dispersant and a step of disintegrating lumps of toner particles and classifying and the separated particles.

6-4.

The method for the production of the flash fixing toner according to the fourth embodiment of this invention which uses an infrared absorbent soluble in the polymerizing monomer composition as already stated in Subsection 4-4 aims to obtain the polymer in the form of minute spherical particles based on the method of suspension polymerization as described above. The production, for example, can be effected by preparing a copolymerizing monomer composition obtained by compounding a polymerizing monomer with a coloring agent, infrared absorbent, and optionally such additives as waxy component, charge controlling agent, and agent for imparting flowability and polymerizing the polymerizing monomer composition based on the method of suspension polymerization.

Specifically, the production of the flash fixing polymer toner of the fourth embodiment of this invention based on the method of suspension polymerization is effected by placing such a polymerizing monomer composition as mentioned above in an aqueous medium, stirring the aqueous medium containing the composition thereby forming liquid drops of a particle diameter aimed at (particles of the polymerizing monomer composition), and polymerizing the liquid drops in the solution. Though the reaction of this suspension polymerization is properly performed either after or during the regulation of the particle diameters of the liquid drops, it is particularly preferably carried out after the regulation of the particle diameters. The regulation of particle diameters, for example, is effected by stirring a suspension having the prescribed components dispersed in an aqueous medium by means of a device (T. K. Homomixer). It is otherwise effected by passing the dispersion once to several times through such a high-speed stirring device as a line mixer (Ebara Milder, for example). By the regulation thus carried out, the particle diameters of the liquid drops mentioned above are adjusted to fall in the approximate range of 0.1–500 μm, preferably 0.5–100 μm, and more preferably 0.5–50 μm, for example. In the other polymerization methods, the regulation of particle diameters is preferred to be similarly implemented while the polymerization is proceeding based on the relevant method of polymerization.

For the suspension polymerization, the dispersants and polymerization initiators which are generally utilized for the suspension polymerization can be used. For example, the same dispersants and polymerization initiators as illustrated formerly in Subsection 6-3 may be included therein.

6-5.

For the production of the flash fixing toner of the fifth embodiment of this invention, the same polymerization method as is used for the production of the flash fixing toner of the third embodiment of this invention described formerly in Subsection 6-3 may be used. In all these polymerization methods, however, the suspension polymerization method proves most advantageous because the toner produced thereby has best physical properties.

Alternatively, the minute particles which are obtained by these polymerization methods, particularly the emulsion polymerization method, may be further treated for agglomeration and converted into toner particles having diameters aimed at. In this case, the components other than the polymerizing monomer may be left unincorporated in the polymerization system and may be incorporated therein during the treatment for agglomeration. They may be otherwise incorporated in both polymerization system and system for the treatment of agglomeration.

Then, in the fifth embodiment of this invention, the infrared absorbent which is insoluble in the polymerizing monomer composition as illustrated formerly in Subsection 4-5 is treated for fine dispersion and then added to any system during the process for the toner production. The time of this addition is not particularly restricted so long as it takes place between the time the polymerizing monomer composition is prepared and the time the ultimately produced toner particles are dried.

Specifically, when the process of production comprises a step of preparing a polymerizing monomer composition in the polymerization system, a step of dispersing the polymerizing monomer composition in a dispersant, a step of subjecting the polymerizing monomer composition to a reaction of polymerization, and further a step of performing a treatment for agglomeration on the product of the polymerization reaction, for example, the addition may be made at any of the component steps mentioned above.

Further, the method of dispersion of the infrared absorbent may assume any of various modes. Specifically, a method which comprises fine dispersing the infrared absorbent in the polymerizing monomer, solvent, aqueous medium, resin, etc. which are used in the polymerization system or the system for agglomeration treatment and then using the resultant dispersion for the addition under discussion may be cited as a concrete example. In the components mentioned above, the resin does not mean the minute spherical particles which are obtained in consequence of the polymerization of the polymerizing monomer composition but means such resin as is capable of being incorporated in the polymerizing monomer composition and is soluble in the polymerizing monomer composition or such resin as is capable of being incorporated in the solvent used for the polymerization system and solved therein.

As concrete examples of the method for finely dispersing the infrared absorbent in such liquid components as polymerizing monomer and solvent, methods which use such high-speed shear type dispersing devices as homomixer, biomixer, and Ebara Milder, such attrition type dispersing devices as colloid mill and homomix line mill, and such media mills as ball mill, side grind mill, pearl mill, and attriter may be cited.

As a concrete example of the method for dispersion in the resin, a method which comprises solving and kneading the infrared absorbent with such components as resin by the use of a roll mill, kneader, pressure kneader, Banbury mixer, Labplast mill, or uniaxial or biaxial kneading and extruding device and finely dispersing the infrared absorbent in such solid components as resin may be cited.

Though the degree with which the infrared absorbent is treated for fine dispersion hinges on the kinds of the polymerizing monomer in which the infrared absorbent is placed and treated for dispersion, the solvent, the aqueous medium, the resin, etc., it is preferred to be such that the dispersed infrared absorbent acquire particle diameters not exceeding about 0.5 μm, preferably falling in the approximate range of 0.01–0.3 μm.

Incidentally, when the infrared absorbent is treated for fine dispersion by such method, absolutely no problem issues from performing this treatment for fine dispersion simultaneously on the coloring agent such as pigment, the charge controlling agent, and the waxy component. The relevant components wished to be dispersed may be used in high concentrations at the time of the dispersion.

The compounds which are used as the dispersant or emulsifier and as the polymerization initiator in suspension polymerization, dispersion polymerization, and emulsion polymerization may include, for example, those compounds formerly illustrated in Subsection 6-3. When the production of the toner of the fifth embodiment of this invention is carried out by the suspension polymerization method or by such other polymerization methods as mentioned above, it is preferable to perform the same operation as that of the regulation of particle diameters already described regarding the suspension polymerization method in Subsection 6-4.

7. Shape and use of flash fixing toner

The flash fixing toner according to this invention which is obtained as described above properly has a volume average particle diameter in the approximate range of 3–15 μm, preferably 5–15 μm, and more preferably 5–10 μm, for example, though this range is variable with such factors as the resolution wished to be attained in the electrophotography. When the toner is obtained by the polymerization method, the shape factor of the produced toner is properly in the range of 100–160, preferably 100–140.

If the volume average particle diameter of the toner exceeds 15 μm, the toner will fail to obtain an image of satisfactory resolution on account of unduly large particle diameter. Conversely, if the diameter is less than 3 μm, the toner, though capable of forming an image of high resolution, will suffer from inferior flowability and will fail to impart stability to the produced image cause such defects as fogging and bad cleaning. If the shape factor of the toner exceeds 160, the toner will be deficient in flowability and the produced image be deficient in resolution.

The xenon flash lamp is used for fixing the flash fixing electrophotographic toner contemplated by this invention.

The xenon flash lamp properly fixes the toner with an electric input energy which is in the range of 1.6–3 J/cm$^2$. If the fixing degree is not less than 70%, the lamp will be used without any trouble. If the fixing degree is not higher than 70%, the fixed toner will be separated by frictional force from the printing sheet and consequently suffered to entail the problem of smearing other object on contact.

The flash fixing toner of this invention can be utilized advantageously in various applications such as, for example, bar code prints, label prints, tag prints, and prints and copies produced by the cursor method or ion flow method. Particularly since it can provide inexpensively even in the mode of embodiment resorting to coloration such products as manifest a perfect flash fixing property, it easily satisfies the needs for coloration of images in such applications.

EXAMPLES

Now, this invention will be described more specifically below with reference to working examples. It should be noted, however, that this invention is not limited in any respect by these examples. Wherever "%" and "part" are mentioned herein below, they are to be construed as meaning the units by weight unless otherwise specified.

Example 1

| | |
|---|---|
| Polyester resin (made by Kao Corporation and commercialized under the trademark of "Tuftone NE1110") | 100 parts |
| Phthalocyanine blue (made by Toyo Ink K. K. and commercialized under the trademark of "Lionel Blue ES") | 5 parts |
| Charge controlling agent (made by Orient Kagaku Kogyo K. K. and commercialized under the trademark of "Bontron E82" | 1 part |
| Infrared absorbent (octakis (anilino) octakis (phenylthio) - vanadyl phthalocyanine) | 0.3 part |

A toner composition using the components shown above was thoroughly mixed in a powder mixing device (made by Fukae Kogyo K.K. and commercialized under the trademark of "High-Speed Mixer") and then solved and kneaded in a Labplast mill (made by Toyo Seiki K.K.). The resultant blend was cooled, then coarsely pulverized, and further finely pulverized with a jet mill. The resultant minute particles were classified with a window classifier to obtain a blue powder having an average particle diameter of 9.2 $\mu$m.

A toner (1) was obtained by uniformly mixing 100 parts of this blue powder with 0.4 part of hydrophobic silica (made by Japan Aerosil K.K. and commercialized under the trademark of "Silica R972") by the use of a Henschel mixer.

The toner (1) thus obtained was rated for fixing degree, tint, fogging on image, and void on fixed image by the following methods. The results are shown in Table 1.

Separately, the solubility (turbidity) of the infrared absorbent to the binding resin in the toner composition mentioned above, the largest absorption spectrum of the infrared absorbent as incorporated in the binding resin, and the heat resistance of the infrared absorbent were measured by the following methods. The results are shown in Table 2.

Example 2

| | |
|---|---|
| Styreneacryl resin (made by Sanyo Kasei K. K. and commercialized under the trademark of "TB-1000") | 80 parts |
| Styreneacryl resin (made by Sanyo Kasei K. K. and commercialized under the trademark of "ST-95") | 20 parts |
| Red pigment (made by Toyo Ink K. K. and commercialized under the trademark of "Lionel Red CP-A") | 7 parts |
| Charge controlling agent (made by Orient Kagaku K. K. and commercialized under the trademark of "Bontron E82") | 1 part |
| Infrared absorbent (made by Nippon Kayaku K. K. and commercialized under the trademark of "Kayasoub CY10") | 0.9 part |

A toner (2) was obtained by following the procedure of Example 1 while using the toner composition shown above instead. This toner (2) had an average particle diameter of 9.5 $\mu$m.

The produced toner (2) was rated for properties in the same manner as in Example 1. The results are shown in Table 1. The infrared absorbent used herein was rated for properties in the same manner as in Example 1. The results are shown in Table 2.

Example 3

| | |
|---|---|
| Polyester resin (made by Kao Corporation and commercialized under the trademark designation of "Tuftone NE1110") | 100 parts |
| Red pigment (made by Toyo Ink K. K. and commercialized under the trademark of "Lionel Red CP-A") | 5 parts |
| Charge controlling agent (made by Orient Kagaku Kogyo K. K. and commercialized under the trademark of "Bontron E82") | 1 part |
| Infrared absorbent (Octakis (anilino) octakis (phenylthio) - vanadyl phthalocyanine) | 0.1 part |

A toner (3) was obtained by following the procedure of Example 1 while using the toner composition shown above instead. This toner (3) had an average particle diameter of 8.4 $\mu$m.

The produced toner (3) was rated for properties in the same manner as in Example 1. The results are shown in Table 1.

Example 4

| | |
|---|---|
| Polyester resin (made by Kao Corporation and commercialized under the trademark of "Tuftone NE1110") | 100 parts |
| Phthalocyanine blue (made by Toyo Ink K. K. and commercialized under the trademark of "Lionel Blue ES") | 5 parts |
| Charge controlling agent (made by Orient Kagaku Kogyo K. K. and commercialized under the trademark of "Bontron E82") | 1 part |
| Infrared absorbent (4-Tetrakis (anilino) - 3,5,6 - dodecafluoro - tin chloride phthalocyanine) | 0.7 part |

A toner (4) was obtained by following the procedure of Example 1 while using the toner composition shown above instead. This toner (4) had an average particle diameter of 8.1 μm. The infrared absorbent used herein was rated for properties in the same manner as in Example 1. The results are shown in Table 2.

Example 5

| | |
|---|---|
| Polyester resin (made by Kao Corporation and commercialized under the trademark of "Tuftone NE1110") | 100 parts |
| Red pigment (made by Toyo Ink K. K. and commercialized under the trademark of "Lionel Red CP-A") | 7 parts |
| Charge controlling agent (made by Orient Kagaku Kogyo K. K. and commercialized under the trademark of "Bontron E84") | 1 part |
| Infrared absorbent (octakis (anilino) octafluorovardyl phthalocyanine) | 0.3 part |

A toner (5) was obtained by following the procedure of Example 1 while using the toner composition shown above instead. This toner (5) had an average particle diameter of 8.2 μm.

The produced toner (5) was rated for properties in the same manner as in Example 1. The results are shown in Table 1. The infrared absorbent used herein was rated for properties in the same manner as in Example 1. The results are shown in Table 2.

Example 6

| | |
|---|---|
| Styreneacryl resin (made by Sanyo Kasei K. K. and commercialized under the trademark of "TB-1000") | 80 parts |
| Styreneacryl resin (made by Sanyo Kasei K. K. and commercialized under the trademark of "TB-95") | 20 parts |
| Red pigment (made by Toyo Ink K. K. and commercialized under the trademark of "Lionel Red CP-A") | 7 parts |
| Charge controlling agent (made by Orient Kagaku Kogyo K. K. and commercialized under the trademark of "Bontron E84") | 1 part |
| Infrared absorbent (Octakis (anilino) octakis (phenylthio)-vanadyl phthalocyanine) | 0.5 part |

A toner (6) was obtained by following the procedure of Example 1 while using the toner composition shown above instead. This toner (6) had an average particle diameter of 7.1 μm.

The produced toner (6) was rated for properties in the same manner as in Example 1. The results are shown in Table 1.

Controls 1 and 2

Toners (C1) and (C2) for comparison were obtained by following the procedures of Examples 1 and 2 while omitting addition of relevant infrared absorbents in the toner compositions of Examples 1 and 2.

The toners (C1) and (C2) for comparison were used as tint standard toners during the rating of tint. The other properties were rated in the same manner as in Example 1. The results are shown in Table 1.

Control 3

A toner (3) for comparison was obtained by following the procedure of Example 2 while changing the infrared absorbent to 3 parts of a cyanine type compound (made by Nippon Kayaku K.K. and commercialized under the trademark of "Kayasoub CY47"). The produced toner (C3) was rated for properties in the same manner as in Example 1. The results are shown in Table 1. The infrared absorbents used herein were rated for properties in the same manner as in Example 1. The results are shown in Table 2.

Control 4 A toner (C4) for comparison was obtained by following the procedure of Example 1 while changing the infrared absorbent to 1 part of nickel complex type compound, bis(1,2'-diphenylecene-1,2-dithiol)nickel.

When the product obtained by the solving and kneading with the Labplast mill was visually inspected, the particles of the infrared absorbent were discerned with unaided eyes.

The toner (C4) thus obtained was rated for properties in the same manner as in Example 1. The results are shown in Table 1. The infrared absorbent used herein was rated for properties in the same manner as in Example 1. The results are shown in Table 2.

Control 5

A toner (C5) for comparison was obtained by following the procedure for the production of the toner (3) for comparison while changing the amount of the infrared absorbent to 0.5 part. The toner (C5) thus obtained was rated for properties in the same manner as in Example 1. The results are shown in Table 1.

Controls 6–8

Toners (C6), (C7), and (C8) for comparison were obtained by following the procedures of Examples 4–6 while omitting the addition of relevant infrared absorbent in the toner compositions of Examples 4–6.

The toners (C6), (C7), and (C8) for comparison were used as tint standard toners for the rating of tint. The other properties were rated in the same manner as in Example 1. The results are shown in Table 1.

Control 9

A toner (C9) for comparison was obtained by following the procedure of Example 5 while changing the infrared absorbent of Example 4 to 5 parts of a cyanine type compound (made by Nippon Kayaku K.K. and commercialized under the trademark of "Kayasoub CY-17"). The toner (C9) thus produced was rated for properties in the same manner as in Example 1. The results are shown in Table 1. The infrared absorbent used herein was rated for properties in the same manner as in Example 1. The results are shown in Table 2.

Control 10

A toner (C10) for comparison was obtained by following the procedure of Example 1 while changing the infrared absorbent of Example 4 to 3.5 parts of a nickel complex type compound, bis(1,2'-diphenylecene-1,2-dithiol)nickel.

The produced toner (C10) was rated for properties in the same manner as in Example 1. The results are shown in Table 1. The infrared absorbent used herein was rated for properties in the same manner as in Example 1. The results are shown in Table 2.

Example 7

A polymerizing monomer composition formed of 85 parts of styrene, 15 parts of n-butyl acrylate, 0.1 part of divinyl benzene, 2 parts of 2,2'-azobisbutyronitrile (made by Nippon Hydrazine Kogyo K.K. and commercialized under the trademark of "ABNR"), 2 parts of 2,2'-azobis(2,4-dimethylvaleronitrile) (ABNV), 6 parts of phthalocyanine blue (made by Toyo Ink K.K. and commercialized under the trademark of "Lionel Blue ES"), 1 part of a charge controlling agent (made by Orient Kagaku Kogyo K.K. and commercialized under the trademark of "Bontron E82"), and 1 part of an infrared absorbent (made by Nippon Kagaku K.K. and commercialized under the trademark of "Kayasoub CY-17") and 130 g of glass beads, 2.5 mm in diameter, were together placed in a mayonnaise vial, 450 ml in inner volume, and dispersed and mixed with a paint shaker for 60 minutes.

The polymerizing monomer composition was uniformly mixed with 430 parts of an aqueous 0.2% Hitenol No. 8 (made by Daiichi Seiyaku K.K.) solution prepared in advance. Then, the mixed solution consequently formed was passed once through a mixing device (made by Ebara Seisakusho K.K. and commercialized under the trademark of "Ebara Milder") which was operated meanwhile under the conditions of 12000 rpm of revolution number and 230 kg/hr of flow volume to obtain a suspension.

In an atmosphere of nitrogen, this suspension was uniformly stirred wholly and heated meanwhile to a degree short of inducing settlement of polymer particles and then left polymerizing at 75° C. for five hours.

The polymer particles in the polymerization solution were tested for particle diameter with a measuring instrument (made by Coulter Electronic Inc. and commercialized under the trademark of "Coulter Multisizer II"). They were consequently found to have a volume average particle diameter of 6.5 μm.

Then, colored minute particles of resin (7) were obtained by repeating the actions of solid-liquid separation and washing on the polymerization solution and then drying the refined solution for 24 hours with a reduced-pressure drier at a temperature of 50° C.

The colored minute particles of resin (7) were used as the master powder for electrophotographic toner. A toner (7) was obtained by thoroughly mixing this master powder with 0.3% of hydrophobic silica (made by Japan Aerosil K.K. and commercialized under the trademark of "Aerosil R-972"). The colored particles of resin (7) had a shape factor of 105.

The toner (7) thus obtained was rated for fixing degree, tint, fogging on image, and resolution by the methods shown herein below. The results are shown in Table 3.

Example 8

A polymerizing monomer composition was obtained by following the procedure of Example 7 while changing the infrared absorbent to 1 part of bis(1,2'-diphenylecene-1,2-dithiol) nickel and the phthalocyanine blue to 5 parts of a red pigment (made by toyo Ink K.K. and commercialized under the trademark of "Lionel Red CP-A"). It was mixed and dispersed in a ball mill for 48 hours.

This polymerizing monomer composition and 430 parts of water containing 0.04% of sodium dodecyl benzene sulfonate and 4% of calcium phosphate prepared in advance were together stirred in a homomixer (made by Tokushu Kika Kogyo K.K.) at 8000 rpm for five minutes to obtain a suspension. Polymerization was carried out by following the procedure of Example 7 while using this suspension instead. When the polymer particles in the polymerization solution were tested for particle diameter in the same manner as in Example 7, they were found to have a volume average particle diameter of 5.1 μm.

Then, colored minute particles of resin (8) were obtained by repeating the actions of solid-liquid separation and washing on the polymerization solution and then drying the refined solution for 24 hours with a reduced-pressure drier at a temperature of 50° C. The colored minute particles of resin (8) were found to have a shape factor of 108.

The colored minute particles of resin (8) were used as the master powder for electrophotographic toner. A toner (8) was obtained by following the procedure of Example 7 while using the master powder instead.

The toner (8) thus obtained was rated for properties in the same manner as in Example 7. The results are shown in Table 3.

Example 9

A polymerizing monomer composition was prepared by following the procedure of Example 7 while changing the infrared absorbent to 0.3 part of octakis(anilino)-octakis (phenylthio)-vanadyl phthalocyanine. The solution was suspended and polymerized and the polymerization solution was tested for particle diameter in the same manner as in Example 7. The polymerization solution was found to have a volume average particle diameter of 6.8 μm. This polymerization solution and a dispersion obtained by dispersing 0.5 part of hydrophobic silica (made by Japan Aerosil K.K. and commercialized under the trademark of "Aerosil R-972") were dispersed and then stirred and mean while heated to 70° C., kept at this temperature for 60 minutes, then subjected to a treatment for agglomeration and fusion, and cooled.

Then, colored minute particles of resin (9), 7.1 μm in volume average particle diameter, were obtained by repeating the actions of solid-liquid separation and washing on the polymerization solution, drying the refined solution for 24 hours with a reduced-pressure drier at a temperature of 50° C., disintegrating the product of drying with a jet mill, and classifying the product of disintegration with a wind classifier. The colored minute particles of resin (9) were found to have a shape factor of 141.

The colored minute particles of resin (9) were used as the master powder for electrophotographic toner. A toner (9) was obtained by following the procedure of example 7 while using the master powder instead.

The toner (9) thus obtained was rated for properties in the same manner as in Example 7. The results are shown in Table 1.

| Control 11 | |
|---|---|
| Styreneacryl resin (made by Sanyo Kasei K. K. and commercialized under the trademark of "TB-1000") | 80 parts |
| Styreneacryl resin (made by Sanyo Kasei K. K. and commercialized under the trademark of "ST-95") | 20 parts |
| Red pigment (made by Toyo Ink K. K. and commercialized under the trademark of "Lionel Red CP-A") | 5 parts |
| Charge controlling agent (made by Orient Kagaku Kogyo K. K. and commercialized under the trademark of "Bontron E82") | 1 part |
| Infrared absorbent (bis(1,2'-diphenylecene-1,2-dithiol)nickel) | 3 parts |

A toner composition using the components shown above was thoroughly mixed by means of a powder mixing device (made by Fukae Kogyo K.K. and commercialized under the trademark of "High-Speed Mixer") and then solved and mixed with a Labplast mill (made by Toyo Seiki K.K.). The resultant mixture was cooled, then coarsely pulverized, and further finely pulverized with a jet mill. The product of fine pulverization thus obtained was classified with a wind classifier to obtain colored minute particles of resin (C11)

for comparison having a volume average particle diameter of 10.1 μm. The colored minute particles of resin (C11) had a shape factor of 172. The colored minute particles of resin (C11) for comparison thus obtained were rated for properties in the same manner as in Example 1. The results are shown in Table 3.

| Control 12 | |
|---|---|
| Polyester resin (made by Kao Corporation and commercialized under the trademark of "Tufton NE1110") | 100 parts |
| Phthalocyanine blue (made by Toyo Ink K. K. and commercialized under the trademark of "Lionel Blue ES") | 5 parts |
| Charge controlling agent (made by Orient Kagaku Kogyo K. K. and commercialized under the trademark of "Bontron E82") | 1 part |
| Infrared absorbent (made by Nippon Kagaku K. K. and commercialized under the trademark of "Kayasoub CY-17") | 1 part |

Colored minute particles of resin (C12) for comparison, 9.5 μm in volume average particle diameter, were obtained by following the procedure of Control 11 while using a toner composition formed of the components shown above instead. The colored minute particles of resin (C12) for comparison were found to have a shape factor of 175. The colored minute particles of resin (C12) for comparison were used as the master powder for electrophotographic toner. A toner (C12) for comparison was obtained by following the procedure of Example 7 while using the master powder instead. The toner (C12) for comparison was rated for properties in the same manner as in Example 1. The results are shown in Table 3.

Control 13

A toner (C13) for comparison was obtained by following the procedure of Example 7 while omitting addition of an infrared absorbent in the polymerizing monomer composition of Example 7. The toner (C13) for comparison thus obtained was rated for properties in the same manner as in Example 7. The results are shown in Table 3.

Example 10

A polymerizing monomer composition was prepared by stirring and solving 85 parts of styrene, 15 parts of n-butyl acrylate, and 0.1 part of divinyl benzene with 0.3 part of an infrared absorbent, octakis(anilino)octafluorovanadyl phthalocyanine and adding to the resultant solution 2 parts of 2,2'-azobisbutyro-nitrile (made by Nippon Hydrazine Kogyo K.K. and commercialized under the trademark of "ABNR"), 2 parts of 2,2'-azobis(2,4-dimethyl valero-nitrile) (ABNV), 6 parts of phthalocyanine blue (made by Toyo Ink K.K. and commercialized under the trademark of "Lionel Blue ES"), and 1 part of a charge controlling agent (made by Orient Kagaku Kogyo K.K. and commercialized under the trademark of "Bontron E82"). The polymerizing monomer composition thus obtained was mixed at 20000 rpm for 10 minutes by the use of a mixing device (made by Nichion Irika Kiki Seisakusho and commercialized under the trademark of "Bio Mixer").

The polymerizing monomer composition was uniformly mixed with 430 parts of an aqueous 0.2% Hitenol No. 8 (made by Daiichi Seiyaku K.K.) solution prepared in advance. Then, the mixed solution consequently formed was passed once through a mixing device (made by Ebara Seisakusho K.K. and commercialized under the trademark of "Ebara Milder") which was operated meanwhile under the conditions of 12000 rpm of revolution number and 230 kg/hr of flow volume to obtain a suspension.

In an atmosphere of nitrogen, this suspension was uniformly stirred wholly and heated meanwhile to a degree short of inducing settlement of polymer particles and then left polymerizing at 750° C. for five hours.

The polymer particles in the polymerization solution were tested for particle diameter with a measuring instrument (made by Coulter Electronics Inc. and commercialized under the trademark of "Coulter Multisizer II"). They were consequently found to have a volume average particle diameter of 6.9 μm.

Then, colored minute particles of resin (10) were obtained by repeating the actions of solid-liquid separation and washing on the polymerization solution and then drying the refined solution for 24 hours with a reduced-pressure drier at a temperature of 50° C.

The colored minute particles of resin (10) were used as the master powder for electrophotographic toner. A toner (10) was obtained by thoroughly mixing this master powder with 0.3% of hydrophobic silica (made by Japan Aerosil K.K. and commercialized under the trademark of "Aerosil R-972").

The toner (10) thus obtained was rated for fixing degree, tint, fogging on image, and resolution by the methods shown herein below. The results are shown in Table 4.

Example 11

A mill base was produced by solving 0.2 part of an infrared absorbent, octakis(anilino)octakis(phenylthio) vanadyl phthalo-cyanine, in 89.8 parts of styrene and then making the resultant solution add 10 parts of a red pigment (made by Toyo Ink K.K. and commercialized under the trademark of "Lionel Red COP-A") and 1 part of a charge controlling agent (made by Orient Kagaku Kogyo K.K. and commercialized under the trademark of "Bontron E82"), and mixing and dispersing the resultant mixture with a ball mill for 48 hours.

A polymerizing monomer composition was prepared by uniformly stirring and mixing 50 parts of the mill base, 40.1 parts of styrene, 15 parts of n-butyl acrylate, 0.1 part of divinyl benzene, 2 parts of 2,2'-azobisbutyronitrile (made by Nippon Hydrazine Kogyo K.K. and commercialized under the trademark of "ABNR"), and 2 parts of 2,2'-azobis(2,4-dimethylvaleronitrile) (ABNV).

This polymerizing monomer composition and 430 parts of water containing 0.04% of sodium dodecyl benzene sulfonate and 4% of calcium phosphate prepared in advance were stirred together in a homomixer (made by Tokushu Kikako K.K.) for 5 minutes at 8000 rpm to obtain a suspension.

Polymerization was performed by following the procedure of Example 10 while using the suspension instead. The polymer particles in the polymerization solution were tested for particle diameter in the same manner as in Example 10. They were consequently found to have a volume average particle diameter of 5.7 μm.

Then, colored minute particles of resin (11) were obtained by repeating the actions of solid-liquid separation and washing on the polymerization solution and then drying the refined solution for 24 hours with a reduced-pressure drier at a temperature of 50° C.

The colored minute particles of resin (11) were used as the master powder for electrophotographic toner. A toner (11) was obtained in the same manner as in Example 10.

The toner (11) thus obtained was rated for properties in the same manner as in Example 10. The results are shown in Table 4.

Example 12

A master batch for infrared absorbent was prepared by mixing 0. 6 part of an infrared absorbent (made by Nippon Kayaku K.K. and commercialized under the trademark of "Kayasoub CY-10") and 60 parts of styreneacryl resin (made by Sanyo Kasei K.K. and commercialized under the trademark of "ST-95") and solving and kneading the resultant mixture by the use of a Labplast mill at 110° C. thereby solving the infrared absorbent in the resin.

A polymerizing monomer composition was prepared by stirring and solving 5.5 parts of the master batch of infrared absorbent with 81 parts of styrene, 14 parts of n-butyl acrylate, and 0.1 part of divinyl benzene, then adding to the resultant mixture 2 parts of 2,2'-azobisbutyronitrile (made by Nippon Hydrazine Kogyo K.K. and commercialized under the trademark of "ABNR"), 2 parts of 2,2'-azobis (2,4-dimethylvaleronitrile) (ABNV), 6 parts of phthalocyanine blue (made by Toyo Ink K.K. and commercialized under the trademark of "Bontron E82"), and 1 part of a charge controlling agent (made by Orient Kagaku Kogyo K.K. and commercialized under the trademark of "Bontron E82"), then following the procedure of Example 10 while changing the infrared absorbent to 0.3 part of octakis (anilino)-octakis-(phenylthio)-vanadyl phthalocyanine. Then, the composition was suspended, polymerized, and tested for particle diameter in the same manner as in Example 10. It was consequently found to have a volume average particle diameter of 7.2 μm.

Subsequently, colored minute particles of resin (12) were obtained by repeating the actions of solid-liquid separation and washing on the polymerization solution and then drying the refined solution for 24 hours with a reduced-pressure drier at a temperature of 50° C.

The colored minute particles of resin (12) were used as the master powder for electrophotographic toner. A toner (12) was obtained in the same manner as in Example 10.

The toner (12) thus obtained was rated for properties in the same manner as in Example 10. The results are shown in Table 4.

Example 13

When 0.6 part of an infrared absorbent (made by Nippon Kayaku K.K. and commercialized under the trademark of "Kayasoub CY-17") in the place of the infrared absorbent of Example 10 was added to a polymerizing monomer and they were stirred and mixed in the same manner as in Example 1, the infrared absorbent could not be solved. Thereafter, a polymerizing monomer composition was prepared, suspended, and polymerized in the same manner as in Example 1 and the polymerization solution consequently obtained was tested for particle diameter. The resultant polymerization solution was consequently found to have a volume average particle diameter of 6.1 μm.

Then, colored minute particles of resin (13) were obtained in the same manner as in Example 10.

When a TEM photograph of the colored minute particles of resin (13) for comparison was visually examined as to the state of dispersion of the infrared absorbent in the particles, it was found that the infrared absorbent was not uniformly dispersed and the particles were large and mostly had diameters in the range of 1–3 μm.

The colored minute particles of resin (13) were used as the master powder for electrophotographic toner. A toner (13) was obtained by following the procedure of Example 10 while using the master powder instead. The produced toner (3) was rated for properties in the same manner as in Example 10. The results are shown in Table 4.

| Control 14 | |
|---|---|
| Styreneacryl resin (made by Sanyo Kasei K. K. and commercialized under the trademark of "TB-1000") | 80 parts |
| Styreneacryl resin (made by Sanyo Kasei K. K. and commercialized under the trademark of "ST-95") | 20 parts |
| Red pigment (made by Toyo Ink K. K. and commercialized under the trademark of "Lionel Red CP-A") | 5 parts |
| Charge controlling agent (made by Orient Kagaku Kogyo K. K. and commercialized under the trademark of "Bontron E82") | 1 part |
| Infrared absorbent (made by Nippon Kayaku K. K. and commercialized under the trademark of "Kayasoub CY-10") | 2 parts |

A toner composition using the components shown above was thoroughly mixed with a powder mixing device (made by Fukae Kogyo K.K. and commercialized under the trademark of "High-Speed Mixer") and then solved and mixed by the use of a Labplast mill (made by Toyo Seiki K.K.). The resultant mixture was cooled, coarsely pulverized, and further pulverized finely with a jet mill. Colored minute particles of resin (C14) for comparison, 10.0 μm in average particle diameter, were obtained by classifying the product of fine pulverization with a wind classifier.

When a TEM photograph of the colored minute particles of resin (C14) for comparison was visually examined as to the state of dispersion of the infrared absorbent in the particles, it was found that the infrared absorbent was dispersed in a very bad state and the particles of the infrared absorbent were large and mostly had diameters in the range of 1–3 μm.

The colored minute particles of resin (C14) for comparison were used as the master powder for electrophotographic toner. A toner (C14) for comparison was obtained by following the procedure of Example 10 while using the master powder instead. The produced toner (C14) was rated for properties in the same manner as in Example 10. The results are shown in Table 4.

Control 15

A polymerizing monomer composition was prepared by following the procedure of Example 1 while omitting addition of a relevant infrared absorbent in the polymerizing monomer composition of Example 10, suspended, and polymerized. The polymerization solution was tested for particle diameter. Consequently, the solution was found to have a volume average particle diameter of 6.5 μm.

Then, colored minute particles of resin (C15) for comparison were obtained by following the procedure of Example 10 while using the polymerization solution instead.

The colored minute particles of resin (C15) for comparison were used as the master powder for electrophotographic toner. A toner (C15) for comparison was obtained by following the procedure of Example 10 while using the master powder instead. The toner (C15) for comparison thus obtained was rated for properties in the same manner as in Example 10. The results are shown in Table 4.

Example 14

A base mill was prepared by mixing 874 parts of styrene, 6 parts of an infrared absorbent, bis(1,2'-diphenylecene-1, 2-dithiol) nickel, 100 parts of a red pigment (made by Toyo Ink K.K. and commercialized under the trademark of "Lionel Red CP-A"), and 20 parts of a charge controlling agent (made by Orient Kagaku Kogyo K.K. and commercialized under the trademark of "Bontron E82") and subjecting the resultant mixture to a treatment for fine dispersion for 10 minutes by the use of a Dyno-Mill (made by Shimmaru Enterprises K.K.) having a vessel, 1 liter in inner volume, packed to 80% of the inner volume thereof with zirconia beads, 0.8 mm in diameter, and operated under the conditions of 15 m/s of peripheral speed of disc and 1500 ml/min of flow rate.

A polymerizing monomer composition was formed by uniformly mixing 50 parts of the mill base, 41.3 parts of styrene, 15 parts of n-butyl acrylate, 0.1 part of divinyl benzene, 2 parts of 2,2'-azobisbutyronitrile (made by Nippon Hydrazine Kogyo K.K. and commercialized under the trademark of "ABNR"), and 2 parts of 2,2'-azobis-(2,4-dimethyl valeronitrile) (ABNV).

A suspension was obtained by adding the polymerizing monomer composition to 430 parts of water containing 0.04% of sodium dodecyl benzene sulfonate and 4% of calcium phosphate prepared in advance and stirring them in a homomixer (made by Tokushu Kika K.K.) at 8000 rpm for five minutes.

In an atmosphere of nitrogen, this suspension was uniformly stirred wholly and heated meanwhile to a degree short of inducing settlement of polymer particles and then left polymerizing at 75° C. for five hours.

The polymer particles in the polymerization solution were tested for particle diameter with a measuring instrument (made by Coulter Electronics Inc. and commercialized under the trademark of "Coulter Multisizer II"). They were consequently found to have a volume average particle diameter of 7.3 μm.

Then, colored minute particles of resin (14) were obtained by repeating the actions of solid-liquid separation and washing on the polymerization solution and then drying the refined solution for 24 hours with a reduced-pressure drier at a temperature of 50° C.

When a TEM photograph of the colored minute particles of resin (14) was visually examined as to the state of dispersion of the infrared absorbent in the particles, it was found that the infrared absorbent was uniformly dispersed in the particles and the particles thereof had diameters of not more than 0.1 μm.

The colored minute particles of resin (14) were used as the master powder for electrophotographic toner. A toner (14) was obtained by adding to the master powder 0.3% of a hydrophobic silica (made by Japan Aerosil K.K. and commercialized under the trademark of "Aerosil R-972") and thoroughly mixing them together.

The toner (14) thus obtained was rated for fixing degree, tint, fogging on image, and resolution by the methods shown herein below. The results are shown in Table 5.

Example 15

An emulsion polymer having a solids content of 30% was obtained by adding a polymerizing monomer composition consisting of 70 parts of styrene and 30 parts of n-butyl acrylate to 230 parts of an aqueous 0.9% Hitenol No. 8 (made by Daiichi Kogyo Seiyaku K.K.) solution prepared in advance, stirring them and meanwhile polymerizing the monomer at 70° C. for eight hours.

This emulsion polymer and 100 parts of an infrared absorbent dispersion prepared in advance under the following conditions, 100 parts of a dispersion of pigment and charge controlling agent, and 5 parts of an aqueous 10% aluminum polychloride solution were stirred together and slowly heated meanwhile to 70° C. and kept at this temperature for one hour. The formation in the meanwhile of an aggregate of resin particles, infrared absorbent, pigment, and charge controlling agent was confirmed with the aid of an optical microscope.

Thereafter, colored minute particles of resin (15), about 8 μm in diameter, were obtained by performing the actions of solid-liquid separation, washing, and drying on the resultant mixture in the same manner as in example 14 and further classifying the refined particles by means of a wind classifier.

When the colored minute particles of resin (15) were tested for particle diameter in the same manner as in Example 14, they were found to have a volume average particle diameter of 7.8 μm.

The colored minute particles of resin (15) were used as the master powder for electrophotographic toner. A toner (15) was obtained by following the procedure of Example 14 while using the master powder instead.

The toner (15) thus obtained was rated for properties in the same manner as in Example 14. The results are shown in Table 5.

Treatment of infrared absorption for fine dispersion

An infrared absorption/methanol/water dispersion was obtained by mixing 1.5 parts of an infrared absorption (made by Nippon Kayaku K.K. and commercialized under the trademark of "Kayasoub CY-10"), 45 parts of methanol, and 253.5 parts of water and subjecting the resultant mixture to a treatment for fine dispersion for 30 minutes by the use of a batch sand mill (having a vessel, 1 liter in inner volume, packed to 80% of the inner volume thereof with zirconia beads, 1.2 mm in diameter, and operated at 15 m/s of peripheral speed of disc).

When the dispersion was examined under an optical microscope to determine the particle diameter of the infrared absorbent, it was found that the infrared absorbent was finely dispersed into particles, not more than 0.3 μm in diameter.

Treatment of pigment and charge controlling agent for fine dispersion

A dispersion of pigment and charge controlling agent was obtained by mixing 15 parts of phthalocyanine blue (made by Toyo Ink K. K. and commercialized under the trademark of "Lionel Blue ES"), 3 parts of a charge controlling agent (made by Orient Kagaku Kogyo K.K. and commercialized under the trademark of "Bontron E82"), 45 parts of methanol, and 237 parts of water and then finely dispersing the resultant mixture under the same conditions as in the treatment of infrared absorbent for fine dispersion.

Example 16

A master batch having an infrared absorbent finely dispersed in resin was formed by mixing parts of polyester resin (made by Kao Incorporation and commercialized under the trademark of "Tuftone NE1110") with 2 parts of an infrared absorbent (made by Nippon Kayaku K.K. and commercialized under the trademark of "Kayasoub CY-17") and solving and kneading the resultant mixture for 20 minutes with hot rolls kept at 115° C.

This master batch was solved in toluene (incapable of solving the infrared absorbent) and the resultant solution was visually examined under a microscope to determine the diameter of the dispersed particles. It was consequently found that the infrared absorbent was finely dispersed into particles, not more than 0.5 μm in diameter.

A dispersion was obtained by mixing 64 parts of styrene, 11.5 parts of n-butyl acrylate, 0.1 part of divinyl benzene, 5 parts of phthalocyanine blue (made by Toyo Ink K.K. and commercialized under the trademark of "Lionel Blue ES"), 1 part of a charge controlling agent (made by Orient Kagaku Kogyo K.K. and commercialized under the trademark of "Bontron E82"), 2 parts of 2,2'-azobisbutyronitrile (made by Nippon Hydrazine Kogyo K.K. and commercialized under the trademark of "ABNR"), and 2 parts of 2,2'-azobis(2,4-dimethyl valeronitrile) (ABNV) and dispersing the resultant mixture at 20000 rpm for 10 minutes by the use of a Mixing device (made by Nichion Irika Kiki Seisakusho and commercialized under the trademark of "Bio Mixer"). The resultant dispersion and 25 parts of the master batch prepared formerly were stirred and mixed together to obtain a polymerizing monomer composition.

The polymerizing monomer composition was uniformly mixed with 430 parts of an aqueous 0.2% Hitenol No. 8 (made by Daiichi Seiyaku K.K.) solution prepared in advance. Then, the mixed solution consequently formed was passed once through a mixing device (made by Ebara Seisakusho K.K. and commercialized under the trademark of "Ebara Milder") which was operated meanwhile under the conditions of 12000 rpm of revolution number and 230 kg/hr of flow volume to obtain a suspension.

This suspension was polymerized in the same manner as in Example 14. The polymerization solution consequently formed was examined to determine the diameter of particles in the same manner as in Example 14. It was consequently found that the particles had a volume average particle diameter of 5.8 μm.

Then, colored minute particles of resin (16) were obtained by performing the actions of solid-liquid separation, washing, and drying on the polymerization solution. The colored minute particles of resin (16) was used as the master powder for electrophotographic toner. A toner (16) was obtained by following the procedure of Example 14 while using the master powder instead.

The toner (16) thus obtained was rated for properties in the same manner as in Example 14. The results are shown in Table 5.

Example 17

A polymerizing monomer composition formed of 85 parts of styrene, 15 parts of n-butyl acrylate, 0.1 part of divinyl benzene, 2 parts of 2,2'-azobisbutyronitrile (made by Nippon Hydrazine Kogyo and commercialized under the trademark of "ABNR"), 2 parts of 2,2'-azobis(2,4-dimethyl valeronitrile) (ABNV), 6 parts of phthalocyanine blue (made by Toyo Ink K.K. and commercialized under the trademark of "Lionel Blue ES"), 1 part of a charge controlling agent (made by Orient Kagaku Kogyo K.K. and commercialized under the trademark of "Bontron E82"), and 0.5 part of an infrared absorbent (made by Nippon Kagaku K.K. and commercialized under the trademark of "Kayasoub CY-17") was placed together with 130 g of glass beads, 25 mm in diameter, in a mayonnaise vial, 450 ml in inner volume, and dispersed and mixed for 60 minutes with a paint shaker.

A suspension was obtained by adding the polymerizing monomer composition to 430 parts of water prepared in advance to contain 0.04% of sodium dodecyl benzene sulfonate and 4% of calcium phosphate and stirring them together for five minutes at 8000 rpm with a homomixer (made by Tokushu Kikako K.K.).

This suspension was polymerized in the same manner as in Example 14. When the polymerization solution consequently obtained was examined to determine the diameter of particles, the particles were found to have a volume average particle diameter of 6.2 μm.

Then, colored fine particles of resin (17) were obtained by solving tricalcium phosphate with hydrochloric acid, repeating the actions of solid-liquid separation and washing on the polymerization solution, and drying the refined solution for 24 hours with a reduced-pressure drier kept at 50° C. of temperature.

When a TEM photograph of the colored minute particles of resin (17) was visually examined as to the state of dispersion of the infrared absorbent in the particles, it was found that the infrared absorbent was finely dispersed uniformly in the particles and the particles thereof had diameters of not more than 2 μm.

The colored minute particles of resin (17) were used as the master powder for electrophotographic toner. A toner (17) was obtained by following the procedure of Example 14 while using the master powder instead.

The toner (17) thus obtained was rated for properties in the same manner as in Example 14. The results are shown in Table 5.

| Control 16 | |
|---|---|
| Styreneacryl resin (made by Sanyo Kasei K. K. and commercialized under the trademark of "TB-1000") | 80 parts |
| Styreneacryl resin (made by Sanyo Kasei K. K. and commercialized under the trademark of "ST-95") | 20 parts |
| Red pigment (made by Toyo Ink K. K. and commercialized under the trademark of "Lionel Red CP-A" | 5 parts |
| Charge controlling agent (made by Orient Kagaku Kogyo K. K. and commercialized under the trademark of "Bontron E82") | 1 part |
| Infrared absorbent (bis(1,2'-diphenylecene-1,2-dithiol)nickel) | 3 parts |

A toner composition using the components shown above was thoroughly mixed with a powder mixing device (made by Fukae Kogyo K.K. and commercialized under the trademark of "High-Speed Mixer") and then solved and mixed by the use of a Labplast mill (made by Toyo Seiki K.K.). The resultant mixture was cooled, coarsely pulverized, and further pulverized finely with a jet mill. Colored minute particles of resin (C16) for comparison, 10.0 μm in average particle diameter, were obtained by classifying the product of fine pulverization with a wind classifier. The colored minute particles of resin (C16) were used as the master powder of electrophotographic toner. A toner (C16) for comparison was obtained by following the procedure of Example 14 while using the master powder instead. The toner (C16) for comparison thus obtained was rated for properties in the same manner as in Example 14. The results are shown in Table 5.

Control 17

Colored minute particles of resin (C17) for comparison were obtained by following the procedure of Example 14 while omitting addition of a relevant infrared absorbent in the polymerizing monomer composition of Example 14.

The colored minute particles of resin (C17) for comparison were used as the master powder for electrophotographic toner. A toner (C17) was obtained by following the procedure of Example 14 while using the master powder instead.

The toner (C17) thus obtained was rated for properties in the same manner as in Example 14. The results are shown in Table 5.

(Rating of properties)

Test for fixing degree

A developing agent formed of 4 parts of a toner and 96 parts of an acryl-modified silicon resin-coated carrier was set in a commercially available copying device (made by Toshiba K.K. and commercialized under the trademark of "Leodry 7610") and used to form an unfixed image. Then, this image was flash fixed by the use of a xenon flash lamp.

This flash fixed image was put to a tape peel test using a scotch mending tape (made by 3M K.K.). The tape peeled from the surface carrying the image was examined to rate the developing agent for residual ratio of image. The residual ratio was reported as the fixing degree.

The residual ratio of image after the separation of the tape was determined by measuring the density of the image before and after the separation of the tape and the magnitude thereof was computed from the following formula.

Fixing degree (%)=(Density of image after tape separation/density of image before tape separation)×100

The density of image was measured by the use of a McBeth reflection densitometer (made by A Division Kollmorgan Corp and commercialized under the trademark of "Type D514").

Rating of tint

Toners containing no infrared absorbent were formed with the compositions severally of working examples and controls and were adopted as tint standard toners. The flash fixed images formed of the toners of the working examples and controls and the open fixed images formed of the tint standard toners were compared in terms of tint with unaided eyes to study the effect of infrared absorbent on tint. The effect was rated on the four-point scale, wherein ◎ No discernible effect on tint observed ○ Slight discernible yet unproblematic effect on tint observed Δ Discernible effect on tint observed × Effect so large as to cause clear change in tint observed Fogging on image The image part on a white background was inspected with a magnifying glass at 20 magnifications to seek toner fogging and the toner fogging was rated on the following three-point scale, wherein ○ Total absence of toner fogging Δ Discernible yet unproblematic toner fogging × Heavy and problematic toner fogging Void in fixed image The wholly black part of a fixed image was visually inspected with a microscope (100 magnifications) to seek voids and the voids were rated on the following three-point scale, wherein ○ No discernible sign of occurrence of void Δ Slight discernible sign of void × Many voids clearly in sight – Image unfixed yet and incapable of rating Resolution The stereophotomicrograph (60 magnifications) of a given sample was visually inspected to determine dot reproducibility of 65 lines/inch and fine line reproducibility of 3.2 lines/mm with the aid of Electrophotographic Society test chart, No. 1-R (1975) and the results were rated on the following three-point scale, wherein ○ Substantially no sign of increase or decrease in size of dots and fine lines, with the test chart reproduced nearly perfectly Δ Slight discernible yet unproblematic sign of increase or decrease in size of dots and fine lines × Conspicuous increase or decrease in size of dots and fine lines, indicative of the presence of a defect (Rating of characteristic properties)

Turbidity (solubility)

An infrared absorbent-containing resin obtained by mixing 100 parts of binding resin with 0.1 part of infrared absorbent, both used in a toner composition of any of the working examples and controls cited above and then solving and kneading the resultant mixture for 10 minutes by the use of a Labplast mill at 120° C. was molded into a film, 0.3 mm in thickness. This film was tested for turbidity by the use of a turbidometer (made by Nippon Denshoku Kogyo K.K. and commercialized under the trademark of "NDl-1000DP").

Largest absorption spectrum

The same film as used for the determination of turbidity mentioned above was examined for the largest absorption spectrum ($\lambda_{max}$) with a spectrophotometer.

Heat resistance

The infrared absorbent used was tested for heat resistance by the following method using a thermal analyzer (made by Shimadzu Seisakusho K.K. and commercialized under the trademark of "DTG-50H"). A sample infrared absorbent was heated in an atmosphere of nitrogen at a temperature increasing rate of 20° C./min. to find the temperature at which a loss of 5% from the weight of the sample at 100° C. occurred. This temperature was reported as the heat resistance temperature (temperature for starting thermal decomposition) of the sample.

TABLE 1

| | Toner | Infrared absorbent* | Added Amount PHR | Mean diameter of toner, μm | Fixing degree, % | Rating of tint | Fogging | Void |
|---|---|---|---|---|---|---|---|---|
| Example 1 | (1) | A | 0.3 | 9.2 | 93 | ◎ | ○ | ○ |
| Example 2 | (2) | B | 0.9 | 9.5 | 78 | ○ | ○ | Δ |
| Example 3 | (3) | A | 0.1 | 8.4 | 85 | ◎ | ○ | ○ |
| Control 1 | (C1) | — | 0 | 9.3 | 11 | Standard for toner (1) | ○ | — |
| Control 2 | (C2) | — | 0 | 8.7 | 23 | Standard for toner (2) | ○ | — |
| Control 3 | (C3) | C | 3.0 | 9.7 | 75 | X | X | X |
| Control 4 | (C4) | D | 1.0 | 9.2 | 25 | ○ | X | — |
| Control 5 | (C5) | C | 0.5 | 9.1 | 32 | ○ | Δ | — |

TABLE 1-continued

| | Toner | Infrared absorbent* | Added Amount PHR | Mean diameter of toner, μm | Fixing degree, % | Rating of tint | Fogging | Void |
|---|---|---|---|---|---|---|---|---|
| Example 4 | (4) | E | 0.7 | 8.1 | 95 | ○ | ○ | ○ |
| Example 5 | (5) | F | 0.2 | 8.4 | 77 | ◎ | ○ | ○ |
| Example 6 | (6) | A | 0.5 | 7.1 | 89 | ◎ | ○ | ○ |
| Control 6 | (C6) | — | 0 | 8.3 | 11 | Standard for toner (4) | ○ | — |
| Control 7 | (C7) | — | 0 | 8.5 | 23 | Standard for toner (5) | ○ | — |
| Control 8 | (C8) | — | 0 | 7.2 | 15 | Standard for toner (6) | ○ | — |
| Control 9 | (C9) | C | 5.0 | 7.7 | 85 | X | X | X |
| Control 10 | (C10) | D | 3.5 | 8.5 | 52 | Δ | Δ | — |

*A octakis(anilino) octakis(phenylthio) vanadyl phthalocyanine
B Kayasoub CY10. made by Nippon Kayaku K. K.
C Kayasoub CY17. made by Nippon Kayaku K. K.
D bis(1,2'-diphenylecene-1,2-dithiol) nickel
E 4-tetrakis(anilino)-3,5,6-dodecafluoro tin chloride phthalocyanine
F octakis(anilino) octafluoro vanadyl phthalocyanine

TABLE 2

| Infrared absorbent | Class | Turbidity, % | $\lambda_{MAX}$, nm | Heat resistance temperature, ° C. |
|---|---|---|---|---|
| Octakis(anilino) octakis (phenylthio) vanadyl phthalocyanine | A phthalocyanine type compound | 1.1 | 964 | 342 |
| Kayasoub CY10 | A cyanine type compound | 3.5 | 799 | 259 |
| Kayasoub CY17 | A cyanine type compound | 11.7 | 807 | 204 |
| bis(1,2'-diphenylecene-1,2-dithiol)nickel | Ni complex compound | Inferior dispersion | 869 | 300 |
| 4-tetrakis(anilino) 3,5,6-dodecafluoro tin chloride phthalocyanine | A phthalocyanine type compound | 8.0 | 805 | 320 |
| octakis(anilino) octafluoro vanadyl phthalocyanine | A phthalocyanine type compound | 2.1 | 890 | 457 |

TABLE 3

| | Method for the production of toner | Toner | Infrared absorbent* | Added Amount % | Mean diameter of toner, μm | Shape factor | Fixing degree % | Fogging | Resolution | Tint |
|---|---|---|---|---|---|---|---|---|---|---|
| Example 7 | Polymerization method | (7) | C | 1.0 | 6.5 | 105 | 78 | ○ | ○ | ○ |
| Example 8 | Polymerization method | (8) | D | 1.0 | 5.1 | 108 | 88 | ○ | ○ | ○ |
| Example 9 | Polymerization method | (9) | A | 0.3 | 6.8 | 141 | 95 | ○ | ○ | ◎ |
| Control 11 | Pulverizing method | (C11) | D | 3.0 | 10.1 | 172 | 25 | X | Δ | Δ |
| Control 12 | Pulverizing method | (C12) | C | 1.0 | 9.5 | 175 | 55 | Δ | Δ | Δ |
| Control 13 | Polymerization method | (C13) | — | — | 6.5 | 105 | 11 | ○ | ○ | ※ |

*A octakis(anilino) octakis(phenylthio) vanadyl phthalocyanine
C Kayasoub CY-17 made by Nippon Kayaku K. K.
D bis(1,2'-diphenylecene-1,2-dithiol) nickel
※ Standard for the toner (7)

TABLE 4

| | Method for the production of toner | Toner | Infrared absorbent* | Amount % | Method for the addition | Mean diameter of toner μm | Fixing degree (%) | Fogging | Resolution | Tint |
|---|---|---|---|---|---|---|---|---|---|---|
| Example 10 | Polymerization method | (10) | F | 0.3 | Dissolved to monomer | 6.9 | 94 | ○ | ○ | ◎ |
| Example 11 | Polymerization method | (11) | A | 0.2 | Dissolved to monomer | 5.7 | 91 | ○ | ○ | ◎ |
| Example 12 | Polymerization method | (12) | C | 0.6 | Dissolved to resin | 7.2 | 86 | ○ | ○ | ○ |
| Example 13 | Polymerization method | (13) | B | 0.6 | Not soluble in monomer | 6.1 | 51 | Δ | ○ | ○ |
| Control 14 | Pulverizing method | (C14) | C | 2.0 | Inferior dispersion | 10.1 | 60 | X | Δ | Δ |
| Control 15 | Polymerization method | (C15) | — | — | | 6.5 | 11 | ○ | ○ | ※ |

*A octakis(anilino) octakis(phenylthio) vanadyl phthalocyanine
B Kayasoub CY-10 made by Nippon Kayaku K. K.
C Kayasoub CY-17 made by Nippon Kayaku K. K.
F octakis(anilino) octafluoro vanadyl phthalocyanine
※ Standard for the toner (10)

TABLE 5

| | Toner | Infrared absorbent* | Added Amount % | Treatment before addition | Mean diameter of dispersed particles, μm | Mean diameter of toner, μm | Fixing degree % | Fogging | Resolution | Tint |
|---|---|---|---|---|---|---|---|---|---|---|
| Example 14 | (14) | D | 0.3 | Wet dispersion | 0.1 | 7.3 | 89 | ○ | ○ | ◎ |
| Example 15 | (15) | B | 0.5 | Wet dispersion | 0.3 | 7.8 | 81 | ○ | ○ | ○ |
| Example 16 | (16) | C | 0.5 | Kneading dispersion | 0.5 | 5.8 | 75 | ○ | ○ | ◎ |
| Example 17 | (17) | C | 0.5 | Omitted | 2 | 6.2 | 65 | ○ | ○ | ○ |
| Control 16 | (C16) | D | 3.0 | Omitted | Inferior | 10.1 | 25 | X | Δ | Δ |
| Control 17 | (C17) | — | — | — | — | 7.0 | 11 | ○ | ○ | ※ |

*B Kayasoub CY-10 made by Nippon Kayaku K. K.
C Kayasoub CY-17 made by Nippon Kayaku K. K.
D bis(1,2'-diphenylecene-1,2-dithiol) nickel
※ Standard for the toner (14)

The entire disclosure of Japanese Patent Application Nos. 9-194,920 filed on Jul. 18, 1997; 9-194,521 filed on Jul. 18, 1997; 9-289,928 filed on Oct. 22, 1997; 9-289,929 filed on Oct. 22, 1997; and 9-289,930 filed on Oct. 22, 1997, each including specification, claims, drawings and summary are incorporated herein by reference in its entirety.

What is claimed is:

1. A flash fixing toner comprising a binding resin, a coloring agent, and an infrared absorbent, said infrared absorbent having the largest absorption wavelength in the range of 750–1100 nm, said infrared absorbent being solved in said binding resin, and said infrared absorbent being incorporated in the toner in an amount in the range of 0.01 wt. %–1 wt. %, based on the total amount of the toner composition.

2. A flash fixing toner according to claim 1, wherein said infrared absorbent is an infrared absorbent which exhibits a turbidity of not more than 10, the turbidity being determined when the infrared absorbent is incorporated in an amount of 0.1 part by weight in 100 parts by weight of said binding resin,.

3. A flash fixing toner according to claim 1, wherein said coloring agent is a coloring agent which produces a color other than black.

4. A flash fixing toner comprising a binding resin, a coloring agent, and an infrared absorbent being solved in said binding resin, said infrared absorbent being a phthalocyanine compound represented by the following general formula (I):

(I)

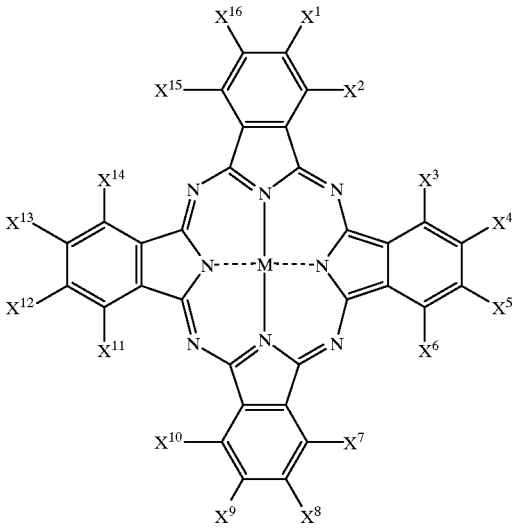

(wherein, at least one of the substituents, $X^1$–$X^{16}$, is NH—R wherein R is an alkyl group of 1–8 carbon atoms or a non-substituted or substituted aryl group and M is a nonmetal, metal, metal oxide, metal carbonyl, or metal halide.

5. A flash fixing toner according to claim 4, wherein said phthalocyanine compound has the largest absorption wavelength peak in the range of 750–1100 nm.

6. A flash fixing toner according to claim 4, wherein said phthalocyanine type compound is a phthalocyanine compound represented by the following general formula (II) or (III)

(II)

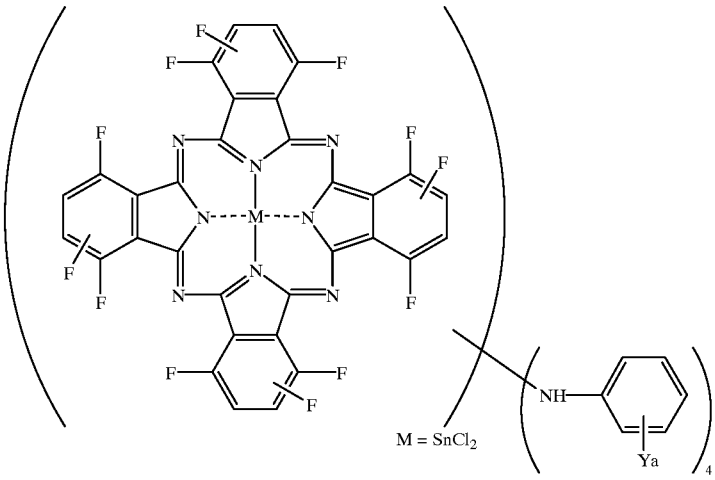

wherein Y is an alkyl group or an alkoxyl group, having 1–4 carbon atoms and a is an integer of 1–2, (III)

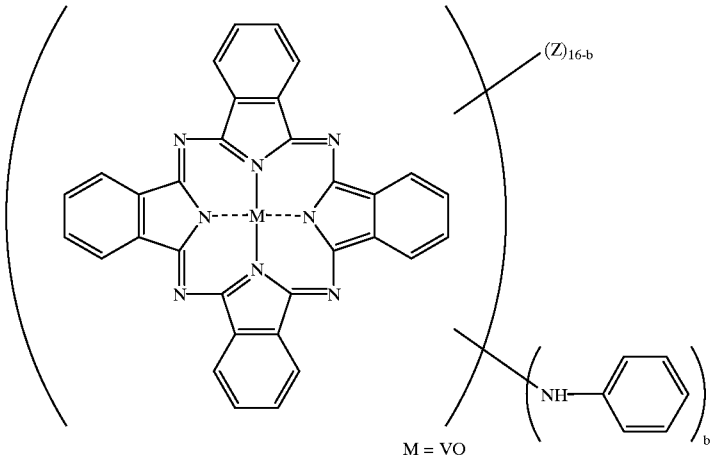

wherein Z is a non-substituted or substituted phenylthio group, non-substituted or substituted phenoxy group, alkoxyl group of 1–8 carbon atoms, alkylthio group of 1–8 carbon atoms, or fluorine atoms, and b is an integer of 6–10.

7. A flash fixing toner according to claim 4, wherein said infrared absorbent is incorporated in an amount in the range of 0.01–5 parts by weight, based on 100 parts by weight of said binding resin.

8. A flash fixing toner according to claim 4, wherein said coloring agent is a coloring agent which produces a color other than black.

9. A polymer toner for flash fixing, which is obtained by polymerizing a polymerizing monomer composition comprising a polymerizing monomer, a coloring agent, and an infrared absorbent being solved therein, said infrared absorbent having the largest absorption wavelength in the range of 750–1100 nm and being incorporated in an amount in the range of 0.01 wt. %–5 wt. %, based on the total amount of the polymerizing monomer composition.

10. A polymer toner according to claim 9, wherein said coloring agent is a coloring agent which produces a color other than black.

11. A polymer toner according to claim 9, wherein said infrared absorbent is contained in the toner particles.

12. A polymer toner for flash fixing, which is obtained by polymerizing a polymerizing monomer composition comprising a polymerizing monomer, a coloring agent, and an infrared absorbent being solved therein, said infrared absorbent having the largest absorption wavelength in the range of 750–1100 nm and said toner having a volume average particle diameter in the range of 3–15 $\mu$m and a shape factor in the range of 100–160.

13. A polymer toner for flash fixing, which is obtained by polymerizing a polymerizing monomer composition comprising a polymerizing monomer, a coloring agent, and an infrared absorbent being solved therein, said infrared absorbent having the largest absorption wavelength in the range of 750–1100nm and said infrared absorbent being solved in said polymerizing monomer composition and being incorporated in an amount in the range of 0.01 wt. %–3 wt. % of the whole amount of said polymerizing monomer composition.

14. A polymer toner according to claim 13, wherein said coloring agent is a coloring agent which produces a color other than black.

15. A polymer toner for flash fixing, which is formed by using particles, which particle is one of a resin particle obtained directly by a polymerization and particle obtained by further subjecting said resin particles to a coagulating treatment, which toner consequently comprises the resin component, and further comprises a coloring agent, and an infrared absorbent being solved therein, said infrared absorbent being incorporated in the toner by adding it to at least one of the polymerization system and the coagulating treatment system after being subjected to a treatment for fine dispersion, and said infrared absorbent having the largest absorption wavelength in the range of 750–1100 nm and being incorporated in an amount in the range of 0.01 wt. %–3 wt. % based on the total amount of the toner.

16. A polymer toner according to claim 15, wherein said coloring agent is a coloring agent which produces a color other than black.

* * * * *